US008883389B2

(12) United States Patent
Matsui et al.

(10) Patent No.: US 8,883,389 B2
(45) Date of Patent: Nov. 11, 2014

(54) DEVELOPING APPARATUS AND DEVELOPING METHOD

(71) Applicant: Canon Kabushiki Kaisha, Tokyo (JP)

(72) Inventors: Takashi Matsui, Suntou-gun (JP); Michihisa Magome, Mishima (JP); Shotaro Nomura, Suntou-gun (JP); Atsuhiko Ohmori, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 75 days.

(21) Appl. No.: 13/725,366

(22) Filed: Dec. 21, 2012

(65) Prior Publication Data

US 2013/0164671 A1 Jun. 27, 2013

(30) Foreign Application Priority Data

Dec. 27, 2011 (JP) ..... 2011-285914

(51) Int. Cl.
*G03G 13/09* (2006.01)
*G03G 15/04* (2006.01)

(Continued)

(52) U.S. Cl.
CPC ..... *G03G 15/081* (2013.01); *G03G 9/0815* (2013.01); *G03G 15/09* (2013.01); *G03G 13/08* (2013.01); *G03G 15/0812* (2013.01); *G03G 9/0819* (2013.01); *G03G 9/0823* (2013.01); *G03G 9/0834* (2013.01); *G03G 9/0835* (2013.01); *G03G 9/0802* (2013.01); *G03G 9/0821* (2013.01); *G03G 9/0833* (2013.01); *G03G 9/0836* (2013.01)
USPC ..... 430/122.51; 430/105; 430/106.1; 430/108.1; 430/123.5; 399/116; 399/119; 399/252

(58) Field of Classification Search
CPC . G03G 15/081; G03G 15/09; G03G 15/0812; G03G 9/0823; G03G 9/0833; G03G 9/0819; G03G 9/0834; G03G 13/08; G03G 9/0836; G03G 9/0802; G03G 9/0821; G03G 9/0815; G03G 9/0835
USPC ..... 430/105, 106.1, 108.1, 122.51, 123.5; 399/116, 119, 252
See application file for complete search history.

(56) References Cited

U.S. PATENT DOCUMENTS 5,948,582 A 9/1999 Nakamura et al.
6,051,350 A 4/2000 Inaba et al.

(Continued)

FOREIGN PATENT DOCUMENTS

CN 1609720 A 4/2005
CN 101589345 A 11/2009

(Continued)

OTHER PUBLICATIONS

Lee, et al., "The Glass Transition Temperatures of Polymers", Polymer Handbook, 2nd Edition, 1975, pp. III-139 to III-192.

(Continued)

*Primary Examiner* — Thorl Chea
(74) *Attorney, Agent, or Firm* — Fitzpatrick, Cella, Harper and Scinto

(57) ABSTRACT

An object of the present invention is to provide a developing apparatus which is less affected by usage environments, has high development efficiency for long term use and can provide a high quality image without image density non-uniformity.

The present invention relates to a developing apparatus wherein a magnetic toner-carrying member has a work function value at the surface thereof within a specific range, a toner regulating member which regulates toner carried on the magnetic toner-carrying member is made of a specific material at a portion contacting the magnetic toner, the magnetic toner has an average circularity of 0.950 or more and the magnetic toner has a surface tension index within a specific range.

5 Claims, 4 Drawing Sheets

(51) Int. Cl.

| | |
|---|---|
| ***G03G 9/08*** | (2006.01) |
| ***G03G 15/09*** | (2006.01) |
| ***G03G 13/08*** | (2006.01) |
| ***G03G 15/08*** | (2006.01) |
| ***G03G 9/083*** | (2006.01) |

(56) References Cited

U.S. PATENT DOCUMENTS

| | | | |
|---|---|---|---|
| 6,077,635 | A | 6/2000 | Okado et al. |
| 6,077,636 | A | 6/2000 | Moriki et al. |
| 6,183,927 | B1 | 2/2001 | Magome et al. |
| 6,287,739 | B1 | 9/2001 | Kawakami et al. |
| 6,447,969 | B1 | 9/2002 | Ito et al. |
| 6,465,144 | B1 | 10/2002 | Hashimoto et al. |
| 6,544,708 | B2 | 4/2003 | Komoto et al. |
| 6,596,452 | B2 | 7/2003 | Magome et al. |
| 6,638,674 | B2 | 10/2003 | Komoto et al. |
| 6,653,035 | B2 | 11/2003 | Komoto et al. |
| 7,043,175 | B2 | 5/2006 | Komoto et al. |
| 7,273,686 | B2 | 9/2007 | Onuma et al. |
| 7,361,442 | B2 | 4/2008 | Otake et al. |
| 7,371,494 | B2 | 5/2008 | Chiba et al. |
| 7,452,649 | B2 | 11/2008 | Magome et al. |
| 7,560,212 | B2 | 7/2009 | Chiba et al. |
| 7,678,523 | B2 | 3/2010 | Hiroko et al. |
| 7,842,446 | B2 | 11/2010 | Yanase et al. |
| 7,906,266 | B2 | 3/2011 | Magome et al. |
| 7,923,190 | B2 | 4/2011 | Magome et al. |
| 7,935,467 | B2 | 5/2011 | Dojo et al. |
| 8,227,162 | B2 | 7/2012 | Sano et al. |
| 8,288,069 | B2 | 10/2012 | Fujikawa et al. |
| 2003/0108364 | A1* | 6/2003 | Do ..... 399/284 |
| 2005/0111885 | A1 | 5/2005 | Ishigaki |
| 2009/0047043 | A1 | 2/2009 | Dojo et al. |
| 2009/0117477 | A1 | 5/2009 | Magome et al. |
| 2009/0233212 | A1 | 9/2009 | Fujikawa et al. |
| 2011/0294056 | A1 | 12/2011 | Magome et al. |
| 2011/0311910 | A1 | 12/2011 | Matsui et al. |

FOREIGN PATENT DOCUMENTS

| | | | |
|---|---|---|---|
| CN | 101910954 | A | 12/2010 |
| JP | 6-301236 | A | 10/1994 |
| JP | 2004-4751 | A | 1/2004 |
| JP | 2007-79118 | A | 3/2007 |
| JP | 2007-334118 | A | 12/2007 |

OTHER PUBLICATIONS

Matsui, et al., U.S. Appl. No. 13/817,782, 371(c) Date: Feb. 19, 2013.
Chinese Office Action dated Jul. 22, 2014 in Chinese Application No. 201210581811.6.

* cited by examiner

DEVELOPING APPARATUS AND DEVELOPING METHOD

BACKGROUND OF THE INVENTION

1. Field of the Invention

The present invention relates to a developing apparatus and a developing method for use in recording methods based on electrophotographic methods and the like.

2. Description of the Related Art

Known developing apparatuses mounted on image-forming apparatuses such as copiers and printers generally have the configuration in which a blade made of rubber or metal serving as a toner regulating member (also referred to as a developing blade) for regulating the toner coat amount is brought into contact with the surface of a toner-carrying member (also referred to as a developing sleeve).

Toner is provided with positive or negative charge by friction between the developing blade and toner and/or friction between the toner-carrying member and toner. It is a general developing method in which a toner-carrying member containing toner which has been thinly applied thereon by the developing blade allows toner to fly and adhere to an electrostatic latent image on the surface of an electrostatic latent image bearing member opposing the toner-carrying member.

It is recently required that the image-forming apparatus technology is directed to actualize high image quality as well as high image stability for long term use. On the other hand, printing environment has been varied and it is highly required to print in environments varying from a high-temperature, high-humidity environment to a low-temperature, low-humidity environment.

In order to fulfill these requirements, there is a need for a developing apparatus as well as magnetic toner in which toner is uniformly charged and which has high transfer property.

In order to fulfill the above requirements, various trials for improving the developing blade, toner-carrying member or the like have been carried out.

Japanese Patent Application Laid-open No. 2004-4751 proposes the hardness and deformation rate on the surface of a developer carrying member and a developing apparatus in which the ten point mean roughness (Rz) of the surface which contacts the developer carrying member of a developer amount regulating blade is 0.3 to 20 μm. In this patent document, non-magnetic black toner is evaluated on the developing apparatus and it is confirmed that it improves solid image density and prevention of unevenness and streaks. On the other hand, stability in a long term durability test has not been sufficiently evaluated.

Japanese Patent Application Laid-open No. 2007-79118 discloses a trial for improving toner melt adhesion and thin line reproducibility by using a specific toner regulating blade to define the adhesion strength between the toner regulating blade and toner. However, in this document, material of the toner regulating blade or the amount of an external additive(s) is not sufficiently optimized, so that there is room for improvement in terms of low density which particularly occurs after a long term durability test.

On the other hand, toner has also been variously improved. Japanese Patent Application Laid-open No. H06-301236 proposes to produce toner fine powder by kneading a binder resin, a magnetic substance and an optional additive and pulverizing and optionally classifying the mixture to produce toner fine powder, adding an external additive to the toner fine powder followed by surface modification using hot air while it is dispersed in order to simultaneously and instantly carry out fixation of the external additive, coating of the magnetic substance and sphering of toner fine powder.

Japanese Patent Application Laid-open No. 2007-334118 proposes toner for developing an electrostatic image in which a binder resin in toner base particles contains a polyester resin at 80 weight % or more and has a wax/silica weight ratio of 0.5 or more, and when the section of the toner base particles is observed by a transmission electron microscope equipped with elemental analysis ability, (a) silica fine particles having an average primary particle diameter of 15 nm or less are contained in a region 0.5 μm or more inside from the toner base particle surface, and (b) when the section of the toner base particles is stained to distinguish a binder resin portion and a wax portion, 50 number % or more of the silica fine particles of the above (a) are present in the wax portion and a peripheral region within 0.1 μm therefrom.

By applying so-called heat sphering treatment, image quality and image stability for long term use are actually improved. However, there is still room for obtaining a developing apparatus and magnetic toner in which magnetic toner can be charged uniformly in order to allow printing in environments varying from a high-temperature, high-humidity environment to a low-temperature, low-humidity environment and which has a broad transfer region. Moreover, there is also room for improvement in toner haing a low development efficiency without image density non-uniformity which may occur due to possible insufficient matching to the developing apparatus.

SUMMARY OF THE INVENTION

In view of the foregoing problems in the prior art, the present invention is to provide a developing apparatus and developing method which have a high development efficiency for long term use in environments varying from a high-temperature, high-humidity environment to a low-temperature, low-humidity environment and can provide high quality images having less image density non-uniformity.

Thus, a first aspect of the present invention is a developing apparatus comprising an electrostatic latent image bearing member on which an electrostatic latent image is formed, magnetic toner for developing the electrostatic latent image, a magnetic toner-carrying member arranged so as to oppose the electrostatic latent image bearing member for carrying and transporting the magnetic toner, and a toner regulating member contacting the magnetic toner-carrying member and regulating the magnetic toner carried on the magnetic toner-carrying member, wherein:

the magnetic toner-carrying member has a work function value of 4.6 eV or more and 4.9 eV or less, a portion of the toner regulating member, which is contacting the magnetic toner, is made of polyphenylene sulfide or a polyolefin, and the magnetic toner i) comprises magnetic toner particles, each of which contains a binder resin and magnetic powder, and inorganic fine powder, ii) has negative charging property, iii) has an average circularity of 0.950 or more, and iv) has a surface tension index I for a 45 volume % aqueous solution of methanol measured by the capillary suction time method and calculated by the following equation (1) of $5.0\times10^{-3}$ N/m or more and $1.0\times10^{-1}$ N/m or less:

$$I=P\alpha/(A\times B\times10^{6}) \quad (1)$$

wherein in the equation (1), I represents the surface tension index (N/m) of the magnetic toner; Pα represents a capillary pressure ($N/m^2$) of the magnetic toner for the 45 volume % aqueous solution of methanol; A represents a specific surface area ($m^2/g$) of the magnetic toner; and B represents a true density ($g/cm^3$) of the magnetic toner.

Further, a second aspect of the present invention is a method for developing an electrostatic latent image formed on an electrostatic latent image bearing member using magnetic toner that is carried on a magnetic toner-carrying member arranged so as to oppose the electrostatic latent image bearing member and that is regulated by a toner regulating member contacting the magnetic toner-carrying member, wherein:

the magnetic toner-carrying member has a work function value at the surface of 4.6 eV or more and 4.9 eV or less, a portion of the toner regulating member, which is contacting the magnetic toner, is made of a polyphenylene sulfide or a polyolefin, and the magnetic toner i) comprises magnetic toner particles, each of which contains a binder resin and magnetic powder, and inorganic fine powder, ii) has negative charging property, iii) has an average circularity of 0.950 or more, and iv) has a surface tension index I for a 45 volume % aqueous solution of methanol measured by the capillary suction time method and calculated by the following equation (1) of $5.0\times10^{-3}$ N/m or more and $1.0\times10^{-1}$ N/m or less:

$$I=P\alpha/(A\times B\times10^6) \quad (1)$$

wherein in the equation (1), I represents the surface tension index (N/m) of the magnetic toner; Pα represents a capillary pressure ($N/m^2$) of the magnetic toner for the 45 volume % aqueous solution of methanol; A represents a specific surface area ($m^2/g$) of the magnetic toner; and B represents a true density ($g/cm^3$) of the magnetic toner.

According to the present invention, a developing apparatus and magnetic toner can be provided which have high development efficiency for long term use in environments varying from a high-temperature, high-humidity environment to a low-temperature, low-humidity environment and can provide a high quality image without image density non-uniformity.

Further features of the present invention will become apparent from the following description of exemplary embodiments (with reference to the attached drawings).

DESCRIPTION OF THE EMBODIMENTS

The present invention relates to a developing apparatus and a developing method. Conventionally known electrophotographic processes can be applied without limitation to an image-forming method and fixing method other than the developing apparatus and the developing method.

The present inventors have conducted, in order to complete the present invention, studies on a developing apparatus which can provide high development efficiency for long term use in environments varying from a high-temperature, high-humidity environment to a low-temperature, low-humidity environment.

Figure 1:
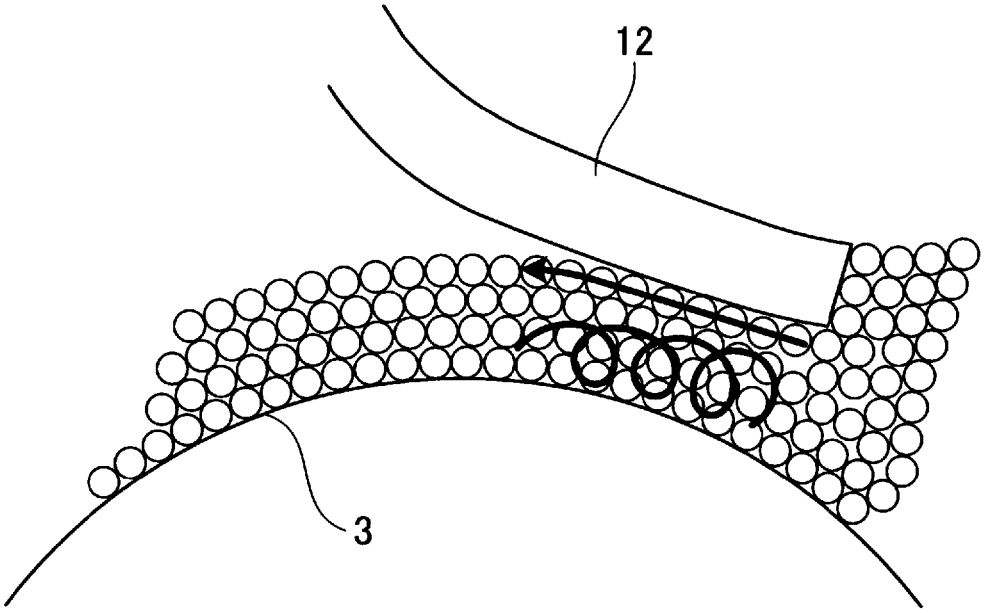
FIG. 1 is a diagram that shows behavior of toner around a magnetic toner-carrying member and a regulating member of a developing apparatus.

First of all, in order to improve the development efficiency, efficient flight of magnetic toner from the surface of a magnetic toner-carrying member to an electrostatic latent image bearing member is important. In order to realize this, it is necessary for a developing apparatus to provide sufficient friction between a toner regulating member (hereinafter also merely referred to as a regulating member) and magnetic toner and/or friction between a magnetic toner-carrying member and magnetic toner to uniformly charge the magnetic toner. In order to realize this, it is important that the magnetic toner is sufficiently circulated at a portion (hereinafter referred to as a regulating portion) where the magnetic toner-carrying member contacts the toner regulating member, so that the magnetic toner is efficiently charged. The magnetic toner in the vicinity of the surface of the magnetic toner-carrying member is transported while being substituted so as to be agitated due to the rotating force of the magnetic toner-carrying member and the pressing pressure from the regulating member which are applied to the regulating portion as well as an influence by the irregularity of the magnetic toner-carrying member (see FIG. 1). The magnetic toner is charged mainly due to the contact thereof with the magnetic toner-carrying member. On the other hand, magnetic toner in the vicinity of the magnetic toner regulating member is relatively distant from the surface irregularity of the magnetic toner-carrying member, so that it is difficult to be agitated. In addition, as the regulating member of magnetic toner and the magnetic toner generally have positive charging property and negative charging property, respectively, electrostatic force may be generated between the toner regulating member and the magnetic toner. Due to this, the magnetic toner is less mobile and less substituted in the vicinity of the toner regulating member. Accordingly, the magnetic toner in the vicinity of the toner regulating member is less agitated and only the magnetic toner contacting the surface of the toner regulating member tends to be charged.

Under such a situation, it is required for the magnetic toner to have high flowability in order to provide sufficient rubbing between the magnetic toner and the toner regulating member to uniformly charge the magnetic toner to a desired level.

However, by using conventional developing apparatuses and magnetic toner, flowability and charge properties of magnetic toner in developing apparatuses may vary under different printing environments and sufficient development efficiency may not be obtained under certain environments.

For example, under a high-temperature, high-humidity environment, possibly due to moisture absorption, magnetic toner tends to have high adhesiveness with the toner regulating member or the magnetic toner-carrying member to reduce its flowability. Due to reduction in the flowability, the magnetic toner is less frequently charged by friction and the charge amount may be decreased.

On the other hand, under a low-temperature, low-humidity environment, conventional magnetic toner may relatively be charged easily.

However, conventional magnetic toner, toner regulating members and magnetic toner-carrying members tend to have broad distribution of the charge amount and therefore it has been frequently difficult to obtain sufficiently high development efficiency. The reason for this is described hereinbelow.

Magnetic toner is charged by friction with the toner regulating member or the magnetic toner-carrying member upon traveling thereof through the regulating portion described above. In terms of the capacity for charging the magnetic toner, the magnetic toner-carrying member relatively easily imparts charge and the toner regulating member less easily imparts charge. However, conventional toner regulating members generally easily impart charge compared to the toner regulating member described hereinbelow which is used for the present invention.

Due to this, conventional developing apparatuses tend to provide excess charge and therefore magnetic toner tends to be charged up. The charged-up magnetic toner tends to adhere to the toner regulating member and the magnetic toner-carrying member. Such adhesion with the members result in insufficient substitution of the magnetic toner at the regulating portion, non-uniform charging, broad distribution of the charge amount and insufficient development efficiency.

As described above, different printing environments may cause change in flowability or the charge amount of the magnetic toner as well as change in the charging property of the magnetic toner-carrying member and the regulating member which regulates the magnetic toner in the developing apparatus, thereby decreasing development efficiency depending on printing environments.

Further, a new observation has been obtained in terms of difference in the printing environments that not only the development efficiency is insufficient but also the transfer efficiency may be insufficient and that image density non-uniformity may occur under certain environments. It has also been a problem that the development efficiency and transfer efficiency tend to be decreased in long term use.

According to the extensive studies carried out by the present inventors without being bound to established practice, they have found that the above problems can be solved by optimizing the toner regulating member, the magnetic toner-carrying member and the magnetic toner, thereby completing the present invention. Namely, according to the present invention, the material of the toner regulating member and the work function value of the magnetic toner-carrying member are controlled when the magnetic toner is charged by the magnetic toner-carrying member and the toner regulating member in the developing apparatus, so that, compared to the conventional configurations of developing apparatuses, the substitution of the magnetic toner at the regulating portion is improved to effectively charge the magnetic toner and the magnetic toner is uniformly charged.

Moreover, as the magnetic toner has increased circularity and increased surface tension, it has less adhesiveness to the toner regulating member and the magnetic toner-carrying member to have increased flowability. Therefore, the magnetic toner itself can also be easily charged in a uniform manner.

It has been found that by means of these synergic effects, the development efficiency can be improved. Moreover, by employing such configurations for the developing apparatus and the magnetic toner, the magnetic toner has increased releasing property from the members in the developing apparatus. Therefore the development efficiency can be increased under various environments and the transfer efficiency can also be significantly improved.

The reason for the above is as follows.

At the regulating portion, the magnetic toner is transported while being agitated, resulting in charging. Conventionally, however, magnetic toner in the vicinity of the magnetic toner-carrying member is agitated and substituted appropriately while it is less substituted in the vicinity of the toner regulating member. In addition, magnetic toner has decreased flowability when it is charged to generate distribution in the charge amount. In contrast, the present inventors came up with an idea that the distribution in the charge amount can be narrowed and the development efficiency can be improved if the magnetic toner in the vicinity of the magnetic toner-carrying member and the toner regulating member at the regulating portion is preferably substituted, the magnetic toner is effectively charged and flowability can be maintained even when the magnetic toner is charged. Accordingly, the present inventors achieved the present invention.

First, the substitution of the magnetic toner can be significantly improved by using polyphenylene sulfides (hereinafter abbreviated as PPSs) or polyolefins for the toner regulating member instead of a conventional material having positive charging property compared to the magnetic toner such as silicon rubbers, polyurethanes, polycarbonates and the like. PPSs and polyolefins have almost the same potential or weakly negative charging property compared to magnetic toner, so that the magnetic toner in the vicinity of the toner regulating member is seldom charged by rubbing and friction with the magnetic toner regulating member.

Due to this, it is believed that electrostatic force against the toner regulating member is extremely low and therefore the magnetic toner does not stick to the toner regulating member. Because of this, it is believed that the magnetic toner in the vicinity of the toner regulating member can be appropriately substituted and the distribution of the charge amount is further narrowed.

However, by using PPSs or polyolefins for the magnetic toner regulating member, the charge amount of the magnetic toner may be reduced. As described hereinabove, the magnetic toner is charged by friction caused by rubbing thereof with both of the magnetic toner-carrying member and the toner regulating member. However, the toner regulating member such as those made of PPSs or polyolefins has very low capacity for charging the magnetic toner. Therefore, charging of the magnetic toner may rely on the contact and rubbing thereof with the magnetic toner-carrying member.

Accordingly, the magnetic toner-carrying member is required to have improved charging property. According to the present invention, the work function value at the surface of the magnetic toner-carrying member is adjusted so as to charge the magnetic toner easily.

Further, in order to maintain the uniform charge amount of the magnetic toner, the flowability of the magnetic toner is improved as well as the frequency of contact and rubbing of the magnetic toner with the magnetic toner-carrying member is increased. In addition, it is necessary to decrease adhesion strength of the magnetic toner with the toner regulating member and the magnetic toner-carrying member in order to maintain flowability even when the magnetic toner is charged.

Thus, the magnetic toner of the present invention aims to have improved flowability and decreased adhesiveness with the above members. As a result of extensive studies carried out by the present inventors, the magnetic toner having high circularity and high surface tension allows improved flowability and reduced adhesion strength with the above members, thereby improving substitution of the magnetic toner at the regulating portion. As a result, the magnetic toner can be effectively and uniformly charged.

As described above, according to the present invention, PPSs or polyolefins are used as the material for the toner regulating member, thereby preventing sticking of the magnetic toner to the toner regulating member and improving substitution of the magnetic toner at the regulating portion. In addition, by adjusting the work function value of the magnetic toner-carrying member to a specific value, the magnetic toner can be effectively and uniformly charged. Due to the improved flowability and decreased adhesion strength with the above members of the magnetic toner, the magnetic toner is better substituted at the regulating portion and can be uniformly charged.

Due to these synergic effects, the magnetic toner has very narrow distribution of the charge amount. Accordingly, the developing bias can be well followed, the development efficiency can be improved and the image density can also be improved.

Next, with regard to the transfer efficiency, the development efficiency of conventional magnetic toner may be sometimes high because less charged toner is entrained in highly charged toner. Because of this, excess magnetic toner is provided to a latent image on an electrostatic latent image bearing member and is difficult to follow transfer bias upon transfer from the electrostatic latent image bearing member to a recording medium, resulting in decreased transfer efficiency. In addition, as the releasing property thereof from the electrostatic latent image bearing member is also low, the transfer efficiency is further decreased or image density non-uniformity is prone to be generated.

In contrast, the magnetic toner of the present invention is uniformly charged and therefore is provided to a latent image on the electrostatic latent image bearing member at an appropriate amount to achieve high development efficiency. Because of this, transfer efficiency can also be easily improved upon transfer from the electrostatic latent image bearing member to the recording medium. Due to the features of the present invention, which are uniform charging and high surface tension of the magnetic toner, namely high releasing property from the members, significantly improved transfer efficiency and improvement in image density non-uniformity are achieved.

The present invention is now described in detail hereinbelow.

The magnetic toner-carrying member which is used for the present invention has the work function value at the surface of 4.6 eV or more and 4.9 eV or less. The work function value is generally indicative of liability to release free electrons with the lower value meaning higher liability to release free electrons. In the context of charging of the surface of the magnetic toner-carrying member and magnetic toner, the surface of the magnetic toner-carrying member having lower work function value allows easier charging of the magnetic toner because free electrons are more easily exchanged when it is brought into contact and rubbed with the magnetic toner. Therefore, it is important that the magnetic toner-carrying member has the work function value at the surface of 4.9 eV or less.

On the other hand, it is not preferable that the magnetic toner-carrying member has the work function value at the surface of more than 4.9 eV because it is difficult to appropriately exchange free electrons between the surface of the magnetic toner-carrying member and magnetic toner, resulting in reduction in the charge amount and charging property of the magnetic toner.

It is not preferable that the magnetic toner-carrying member has the work function value at the surface of less than 4.6 eV because, although the magnetic toner has preferable charging property, the charge amount of the magnetic toner is excessive, thereby increasing the reflection force. As a result, the magnetic toner on the magnetic toner-carrying member becomes less mobile, broadening the distribution of the charge amount.

In the present invention, adjustment of the work function value at the surface of the magnetic toner-carrying member may be suitably exemplified by inclusion of conductive particles described below in a resin layer forming a surface layer of the magnetic toner-carrying member. The conductive particles may include fine powder of metal (aluminum, copper, nickel, silver and the like), particles of conductive metal oxides (antimony oxide, indium oxide, tin oxide, titanium oxide, zinc oxide, molybdenum oxide, potassium titanate and the like), crystalline graphite, carbon fibers, conductive carbon black and the like.

In the present invention, the type of these conductive particles and the amount thereof may be appropriately selected in order to adjust the work function value at the surface of the magnetic toner-carrying member.

The work function value can be decreased by, for example, adding conductive particles having low work function values such as aluminum, copper, silver, nickel and the like metal powder or graphite at a high amount. It is also possible to increase the work function value by adding oxidized carbon black or decreasing the amount of the conductive particles per se.

Carbon black can be oxidized by known techniques which can be exemplified by, for example, surface oxidization with ozone and the like, oxidization with potassium permanganate and the like. By oxidizing the surface of carbon black according to such a technique, the surface of carbon black is provided with surface functional groups such as carboxyl and sulfonate groups that can increase the work function value.

In the present invention, the magnetic toner-carrying member preferably has the surface roughness (arithmetic-mean roughness: RaS) of 0.60 μm or more and 1.50 μm or less and the ratio [RaS/RaB] of the surface roughness (arithmetic-mean roughness: RaS) of the magnetic toner-carrying member to the surface roughness (arithmetic-mean roughness: RaB) of a portion where the toner regulating member contacts the magnetic toner is preferably 1.0 or more and 3.0 or less. The surface roughness (arithmetic-mean roughness: RaS) of the magnetic toner-carrying member is more preferably 0.8 μm or more and 1.3 μm or less and the [RaS/RaB] is more preferably 1.5 or more and 2.5 or less.

As described above, it is very important in the present invention to appropriately substitute the magnetic toner at the regulating portion. The driving force for the substitution of the magnetic toner is the surface irregularity of the magnetic toner-carrying member. However, the magnetic toner in the vicinity of the toner regulating member which is relatively distant from the magnetic toner-carrying member can hardly receive the influence thereof. Therefore, it is believed that imparting irregularity to the surface of the toner regulating member allows appropriate substitution of the magnetic toner.

Based on the extensive studies carried out by the present inventors, the development efficiency can be further improved when RaS is 0.60 μm or more and 1.50 μm or less and RaS/RaB is 1.0 or more and 3.0 or less.

When the magnetic toner-carrying member has the surface roughness (RaS) within the above range, appropriate transport property can be maintained and when the ratio [RaS/RaB] of the surface roughness (RaS) of the magnetic toner-carrying member to the surface roughness (RaB) of a portion where the toner regulating member contacts with the magnetic toner is within the above range, preferable property can be obtained in terms of substitution of the magnetic toner.

The magnetic toner-carrying member of the present invention having the surface roughness (RaS) within the above range can be obtained by, for example, altering the ground condition of the surface layer of the magnetic toner-carrying member or by adding spherical carbon particles, carbon fine particles, graphite, resin fine particles and the like. The surface roughness (RaB) of the toner regulating member can be adjusted by applying taper grinding on the surface of the toner regulating member.

The toner regulating member which is used for the present invention is made of a polyphenylene sulfide (PPS) or a polyolefin at a portion contacting the magnetic toner, as described above.

PPSs and polyolefins have almost the same potential or weakly negative charging property compared to the magnetic toner and therefore the magnetic toner in the vicinity of the toner regulating member is seldom charged by rubbing and friction with the toner regulating member. Therefore it is believed that the magnetic toner has an extremely low electrostatic force to the toner regulating member, so that it does not stick to the toner regulating member. Because of these reasons, a portion where the toner regulating member contacts with the magnetic toner contains a PPS or a polyolefin in the present invention.

The toner regulating member containing a polyphenylene sulfide or a polyolefin at a portion contacting the magnetic toner has reduced chipped amount due to friction or less change in elasticity under various environments, making it possible to stabilize the image quality for long term use and maintain high development efficiency and transfer efficiency under various environments.

The magnetic toner of the present invention has the average circularity of 0.950 or more and preferably 0.960 or more. The magnetic toner having the average circularity of 0.950 or more has improved flowability. The magnetic toner having high average circularity has uniform surface profile compared to magnetic toner having low average circularity such as conventional non-spherical toner and the like, and therefore is uniformly charged. The magnetic toner which has an almost spherical shape has less contact points with a member and thus improved releasing property from the member. The magnetic toner having an almost spherical shape makes the closest packing thereof possible. Because of these reasons, the development efficiency and transfer efficiency are improved and the image quality for long term use is also stabilized.

In the present invention, it is preferable that an aspect ratio measured with a flow particle imaging analyzer "FPIA-3000" (Sysmex Corporation) of the magnetic toner of 2 μm or more and 10 μm or less is 0.7 or more and 0.9 or less. When the aspect ratio is 0.7 or more, which is an index of irregular-shape particles, the magnetic toner contains less irregular-shape toner such as cohered magnetic toner and thus is able to be uniformly charged and has improved development efficiency. When the aspect ratio is 0.9 or less, the magnetic toner tends to have low aspect ratio standard deviation and improved flowability, thereby allowing better image quality.

It is also preferable that with regard to the aspect ratio measured with the flow particle imaging analyzer "FPIA-3000" (Sysmex Corporation), the standard deviation is preferably 0.1 or less when the particles are divided to those having a circle-equivalent diameter of 0.5 μm or more and less than 2.0 μm, those having 2.0 μm or more and less than 10.0 μm and those having 10.0 μm or more and less than 20.0 μm.

When the standard deviation of the aspect ratio is 0.1 or less, the aspect ratio of the magnetic toner is almost equalized throughout the magnetic toner having small particle diameter to that having large particle diameter, thus the magnetic toner tends to have improved flowability and can easily provide better image quality.

The magnetic toner of the present invention preferably has the weight-average particle diameter (D4) of 3.0 μm or more and 10.0 μm or less and more preferably 4.0 μm or more and 7.0 μm or less. The magnetic toner having the weight-average particle diameter (D4) within the above range is preferable in terms of further improving image quality and transfer efficiency. The weight-average particle diameter (D4) of the magnetic toner can be adjusted by classifying the magnetic toner particles during the toner production stage.

The magnetic toner of the present invention has a surface tension index I for a 45 volume % aqueous solution of methanol measured by the capillary suction time method and calculated by the following equation (1) of $5.0\times10^{-3}$ N/m or more and $1.0\times10^{-1}$ N/m or less:

$$I=P\alpha/(A\times B\times10^{6}) \quad (1)$$

wherein in the equation (1), I represents the surface tension index (N/m) of the magnetic toner; Pα represents a capillary pressure ($N/m^2$) of the magnetic toner for the 45 volume % aqueous solution of methanol; A represents a specific surface area ($m^2/g$) of the magnetic toner; and B represents a true density ($g/cm^3$) of the magnetic toner.

The surface tension index of the magnetic toner is indicative of releasing property on the surface of the magnetic toner. The higher surface tension index means higher releasing property, i.e., lower adhesion strength of the magnetic toner. The surface tension index defined herein is calculated from the capillary pressure of the magnetic toner when it is applied with pressure and allowed to suction methanol on its microstructure, the specific surface area of the magnetic toner and the true density of the magnetic toner.

The hydrophobicity and releasing property of the magnetic toner have been conventionally evaluated, for example, based on methanol wetting properties. Methanol wetting properties are significantly affected by an external additive because an aqueous solution of methanol cannot penetrate into the minute region on the surface of the magnetic toner. Because of this, the influences by the magnetic toner particles and the minute region on the surface of the magnetic toner are less reflected and thus development efficiency under various environments and influence upon long term use cannot be evaluated.

On the other hand, the surface tension index of the magnetic toner allows evaluation of releasing property of the magnetic toner including the influence by more minute structure compared to the conventional evaluation.

The present inventors are in opinion that by considering the influence from such a minute structure, the releasing property of the magnetic toner from a member can be discussed.

The magnetic toner has the surface tension index I of $5.0\times10^{-3}$ N/m or more and $1.0\times10^{-1}$ N/m or less and preferably $5.0\times10^{-3}$ N/m or more and $3.0\times10^{-2}$ N/m or less.

The magnetic toner having the surface tension index I of $5.0\times10^{-3}$ N/m or more and $1.0\times10^{-1}$ N/m or less has high releasing property and thus high rolling property, so that it can be effectively and uniformly charged. In addition, as it has better releasing property from a member, it has improved development efficiency and transfer efficiency.

The magnetic toner having the surface tension index I of less than $5.0\times10^{-3}$ N/m has decreased uniform charging property and decreased releasing property, thereby decreasing the development efficiency and the transfer efficiency as well as generating image density non-uniformity.

On the other hand, the magnetic toner having the surface tension index I of more than $1.0\times10^{-1}$ N/m is significantly deteriorated during long term use, resulting in decreased image quality upon long term use.

In the present invention, the above surface tension index can be achieved by uniformly imparting hydrophobicity to the magnetic toner particles and the surface of the magnetic toner including an external additive.

Hydrophobicity can be uniformly provided on the surface of the magnetic toner specifically by, for example, treating the surface of the magnetic toner with a known hydrophobic substance (treatment agent). Such a treatment agent can be coupling agents, fine particles treated with coupling agents, waxes, oil, varnish, organic compounds and the like.

Specifically, hydrophobicity can be imparted by, upon surface treatment of the magnetic toner with hot air, treating the surface of the magnetic toner particles with wax. However, this method does not limit the present invention.

When the magnetic toner is surface treated with hot air while providing an excess amount of heat on the surface of the magnetic toner, an excess amount of wax may be transferred onto the surface of the magnetic toner particles or uneven distribution of wax may result. In order to address this problem, production conditions such as temperature of hot air, temperature of cooling air and the like may be controlled, so that the elution amount and distribution of wax are controlled, thereby obtaining the magnetic toner having the surface tension index I within the above range. According to this, the charge amount of the magnetic toner tends to be uniform and the charge amount is stabilized under various environments.

The magnetic toner of the present invention comprises magnetic toner particles and inorganic fine powder. It is preferable that the inorganic fine powder comprises a silica fine powder. It is also preferable that the magnetic toner of the present invention has the reduction rate of a silicon element of 10 mass % or more and 50 mass % or less when it is soaked in a 1 Normal (hereinafter abbreviated as 1 N) alkaline aqueous solution. In this context, the silicone element is the silicone element derived from the silica fine powder. The treatment method with the alkaline aqueous solution is described in detail hereinbelow. By soaking the magnetic toner in the alkaline aqueous solution, the silicon compound weakly adhered onto the magnetic toner is detached therefrom. The reduction rate of the silicon element intends to calculate the proportion of the silicon compound detached from the magnetic toner.

The magnetic toner having the reduction rate of the silicon element of 50 mass % or less when it is treated with an alkaline aqueous solution comprises more silicon elements strongly adhered to the magnetic toner and thus can easily maintain the surface tension index I described above when it is used for a long term. Therefore, the development efficiency and transfer efficiency can be easily maintained for a long term, image quality can be maintained and images without image density non-uniformity can be continuously obtained. When the reduction rate of the silicon element is 10 mass % or more, the magnetic toner tends to have high rolling property and better rising of charging, resulting in better initial development efficiency and transfer efficiency.

In the present invention, the binder resin for the magnetic toner can be various resins which have been conventionally known as a binder resin. Such resins may include, for example, vinyl resins, phenolic resins, natural resin-modified phenolic resins, natural resin-modified maleic resins, acrylic resins, methacrylic resins, polyvinyl acetate, silicone resins, polyester resins, polyurethanes, polyamide resins, furan resins, epoxy resins, xylene resins, polyvinyl butyral, terpene resins, coumarone-indene resins, petroleum resins and the like, among which polyester resins and vinyl resins are preferred in view of charging property and fixing performance. One as a sole or two or more in combination of these resins can be used as a binder resin.

Monomers which form the polyester resins may include the followings.

The alcohol component may include ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, bisphenol derivatives represented by the following formula (1-1) and diols represented by the following formula (1-2).

[C1]

(1-1)

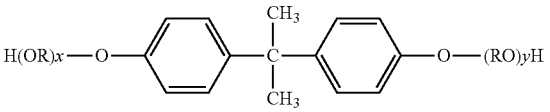

(In the formula, R represents an ethylene or propylene group, x and y are respectively an integer of 1 or more and the average of x + y is 2 to 10.)

(1-2)

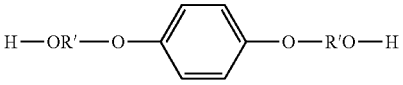

(In the formula, R′ represents

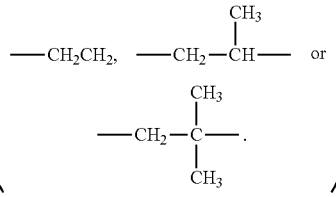

)

The acid component which forms the polyester resins may include benezenedicarboxylic acids or anhydrides thereof such as phthalic acid, terephthalic acid, isophthalic acid and phthalic anhydride; alkyldicarboxylic acids or anhydrides thereof such as succinic acid, adipic acid, sebacic acid and azelaic acid, and succinic acid or anhydride thereof which are substituted by an alkyl or alkenyl group having 6 to 18 carbon atoms; and unsaturated dicarboxylic acids or anhydrides thereof such as fumaric acid, maleic acid, citraconic acid and itaconic acid.

The polyester resins which contain a trivalent or higher valent polyvalent carboxylic acid or an anhydride thereof and/or a trivalent or higher valent polyvalent alcohol are preferable because molecular weight and viscosity can be easily controlled. The trivalent or higher valent polyvalent carboxylic acid or anhydrides thereof may include 1,2,4-benzenetricarboxylic acid, 1,2,4-cyclohexanetricarboxylic acid, 1,2,4-naphthalenetricarboxylic acid, pyromellitic acid, acid anhydrides thereof and lower alkyl esters thereof. The trivalent or higher valent polyvalent alcohol may include 1,2,3-propanetriol, trimethylolpropane, hexanetriol, pentaerythritol and the like.

Vinyl monomers which form the vinyl resins may include the followings:

styrene; styrene derivatives such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene and p-n-dodecylstyrene; unsaturated monoolefins such as ethylene, propylene, butylene and isobutylene; unsaturated polyenes such as butadiene and isoprene; vinyl halides such as vinyl chloride, vinylidene chloride, vinyl bromide and vinyl fluoride; vinyl esters such as vinyl acetate, vinyl propionate and vinyl benzoate; α-methylene aliphatic monocarboxylic esters such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; acrylic esters such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate and phenyl acrylate; vinyl ethers such as vinyl methyl ether, vinyl ethyl ether and vinyl isobutyl ether; vinyl ketones such as vinyl methyl ketone, vinyl hexyl ketone and methyl isopropenyl ketone; N-vinyl compounds such as N-vinylpyrrol, N-vinylcarbazole, N-vinylindole and N-vinylpyrrolidone; vinylnaphthalenes; acrylic or methacrylic derivatives such as acrylonitrile, methacrylonitrile and acrylamide;

further, unsaturated dibasic acids such as maleic acid, citraconic acid, itaconic acid, alkenyl succinic acid, fumaric acid and mesaconic acid; unsaturated dibasic anhydrides such as maleic anhydride, citraconic anhydride, itaconic anhydride and alkenyl succinic anhydride; half esters of unsaturated dibasic acids such as maleic acid methyl half ester, maleic acid ethyl half ester, maleic acid butyl half ester, citraconic acid methyl half ester, citraconic acid ethyl half ester, citraconic acid butyl half ester, itaconic acid methyl half ester, alkenyl succinic acid methyl half ester, fumaric acid methyl half ester and mesaconic acid methyl half ester; unsaturated dibasic esters such as dimethyl maleate and dimethyl fumarate; α,β-unsaturated acids such as acrylic acid, methacrylic acid, crotonic acid and cinnamic acid; α,β-unsaturated acid anhydrides such as crotonic anhydride and cinnamic anhydride, anhydrides of α,β-unsaturated acids and lower fatty acids; alkenyl malonic acid, alkenyl glutaric acid, carboxylic group-containing monomers such as alkenyl adipic acid, acid anhydrides thereof and monoesters thereof;

further, hydroxy group-containing monomers such as acrylic or methacrylic esters such as 2-hydroxyethyl acrylate, 2-hydroxyethyl methacrylate and 2-hydroxypropyl methacrylate; 4-(1-hydroxy-1-methylbutyl)styrene and 4-(1-hydroxy-1-methylhexyl)styrene.

In the present invention, the vinyl resins used for the binder resin constituting the magnetic toner may have a cross-linked structure having two or more vinyl groups crosslinked with a crosslinking agent. In this case, the crosslinking agent may include the followings:

aromatic divinyl compounds, e.g., divinylbenzene and divinylnaphthalene;

diacrylate compounds linked via an alkyl chain, e.g., ethylene glycol diacrylate, 1,3-butylene glycol diacrylate, 1,4-butanediol diacrylate, 1,5-pentanediol acrylate, 1,6-hexanediol diacrylate, neopentyl glycol diacrylate and methacrylate substitutes thereof in which the acrylates are replaced by methacrylates;

diacrylate compounds linked via an alkyl chain containing an ether bond, e.g., diethylene glycol diacrylate, triethylene glycol diacrylate, tetraethylene glycol diacrylate, polyethylene glycol #400 diacrylate, polyethylene glycol #600 diacrylate, dipropylene glycol diacrylate and methacrylate substitutes thereof in which the acrylates are replaced by methacrylates;

diacrylate compounds linked via a chain containing an aromatic group and an ether bond, e.g., polyoxyethylene (2)-2,2-bis(4-hydroxyphenyl)propane diacrylate, polyoxyethylene (4)-2,2-bis(4-hydroxyphenyl)propane diacrylate and methacrylate substitutes thereof in which the acrylates are replaced by methacrylates;

polyester type diacrylate compounds, e.g., trade name MANDA (Nippon Kayaku Co., Ltd.).

Polyfunctional crosslinking agents may include pentaerythritol triacrylate, trimethylolethane triacrylate, trimethylolpropane triacrylate, tetramethylolmethane tetraacrylate, oligoester acrylates and methacrylate substitutes thereof in which the acrylates are replaced by methacrylates; triallyl cyanurate and triallyl trimellitate.

The amount of the crosslinking agent to be used is preferably, relative to 100 mass parts of other monomer components, 0.01 mass parts to 10 mass parts and still more preferably 0.03 mass parts to 5 mass parts.

Among these crosslinking monomers, aromatic divinyl compounds (particularly divinylbenzene) and diacrylate compounds linked via a chain containing an aromatic group and an ether bond may be mentioned as the compounds which are suitably used for the binder resin in view of stability for a long term use.

A polymerization initiator which is used for production of the vinyl resins may include 2,2'-azobisisobutyronitrole, 2,2'-azobis(4-methoxy-2,4-dimethylvaleronitrole), 2,2'-azobis(2,4-dimethylvaleronitrole), 2,2'-azobis(2-methylbutyronitrole), dimethyl-2,2'-azobisisobutyrate, 1,1'-azobis(1-cyclohexanecarbonitrole), 2-(carbamoylazo)-isobutyronitrile, 2,2'-azobis(2,4,4-trimethylpentane), 2-phenylazo-2,4-dimethyl-4-methoxyvaleronitrole, 2,2-azobis(2-methylpropane), ketone peroxides such as methyl ethyl ketone peroxide, acetyl acetone peroxide and cyclohexanone peroxide, 2,2-bis(t-butylperoxy)butane, t-butyl hydroperoxide, cumene hydroperoxide, 1,1,3,3-tetramethylbutyl hydroperoxide, di-t-butyl peroxide, t-butyl cumyl peroxide, dicumyl peroxide, α,α'-bis(t-butylperoxyisopropyl)benzene, isobutyl peroxide, octanoyl peroxide, decanoyl peroxide, lauroyl peroxide, 3,5,5-trimethyl hexanoyl peroxide, benzoyl peroxide, m-trioyl peroxide, diisopropyl peroxy dicarbonate, di-2-ethylhexyl peroxy dicarbonate, di-n-propyl peroxy dicarbonate, di-2-ethoxyethyl peroxy carbonate, dimethoxy isopropyl peroxy dicarbonate, di(3-methyl-3-methoxybutyl) peroxy carbonate, acetyl cyclohexyl sulfonyl peroxide, t-butyl peroxy acetate, t-butyl peroxy isobutyrate, t-butyl peroxy neodecanoate, t-butyl peroxy 2-ethylhexanoate, t-butylperoxylaurate, t-butyl peroxy benzoate, t-butyl peroxy isopropylcarbonate, di-t-butyl peroxy isophthalate, t-butyl peroxy allylcarbonate, t-amyl peroxy 2-ethylhexanoate, di-t-butyl peroxy hexahydroterephthalate and di-t-butylperoxy azelate.

The binder resin used for the present invention preferably has a glass transition temperature (Tg) of 45° C. to 70° C. and more preferably 55° C. to 67° C. It is also preferable that the binder resin has a number-average molecular weight (Mn) of 2,500 to 50,000 and a weight-average molecular weight (Mw) of 10,000 to 1,000,000.

The number-average molecular weight and weight-average molecular weight of the binder resin can be determined from the count (retention time) measured by gel permeation chromatography (GPC) of the solution of the binder resin in tetrahydrofuran (THF) and the logarithmic value of calibration curves prepared from several monodisperse polystyrene standard samples. The molecular weight of the binder resin can be adjusted by polymerization conditions, the presence or absence of crosslinking agent, kneading of the binder resin and the like.

The glass transition temperature of the binder resin can be generally adjusted by selecting components (polymerizable monomers) of the binder resin so as to obtain the theoretical glass transition temperature of 45 to 80° C. which is described in the publication Polymer Handbook 2nd edition III, p. 139-192 (John Wiley & Sons). The glass transition temperature of the binder resin can be measured by using a differential scanning calorimeter, e.g., DSC-7 from PerkinElmer Inc. or DSC2920 from TA Instruments, Inc. Japan, according to ASTM D3418-82. The binder resin having a glass transition temperature lower than the above range may provide insufficient storage property of the magnetic toner and the binder resin having a glass transition temperature higher than the above range may provide insufficient fixing performance of the magnetic toner.

The binder resin can be produced by utilizing conventionally known various production methods without limitation. For example, polymerization methods such as bulk polymerization method, solution polymerization method, suspension polymerization method and emulsion polymerization method can be used. When carboxylic monomers or acid anhydride monomers are used, the bulk polymerization method or the solution polymerization method is preferably used due to the nature of the monomers.

In the present invention, the magnetic toner may contain a wax. The wax is preferably a hydrocarbon wax such as low molecular weight polyethylenes, low molecular weight polypropylenes, microcrystalline wax, paraffin wax because they are easily dispersed in the magnetic toner and have high releasing property. Other than the above hydrocarbon wax, a small amount of one or two or more waxes may be used in combination, if necessary. Such a wax may include the followings:

oxides of aliphatic hydrocarbon waxes or block copolymers thereof such as oxidized polyethylene wax; waxes containing a fatty acid ester as a main component such as carnauba wax, Sasol Wax and montan ester wax; and partially or fully deacidified fatty acid esters such as deacidified carnauba wax; further, saturated straight-chain fatty acids such as palmitic acid, stearic acid, montanic acid; unsaturated fatty acids such as brassidic acid, eleostearic acid and parinaric acid; saturated alcohols such as stearyl alcohol, aralkyl alcohols, behenyl alcohol, carnaubyl alcohol, ceryl alcohol and melissyl alcohol; long-chain alkyl alcohols; polyalcohols such as sorbitol; fatty acid amides such as linoleic amide, oleic amide and lauric amide; saturated fatty acid bisamides such as methylene-bis-stearic amide, ethylene-bis-capric amide, ethylene-bis-lauric amide and hexamethylene-bis-stearic amide; unsaturated fatty acid amides such as ethylenebis oleic amide, hexamethylene-bis-oleic amide, N,N'-dioleyladipic amide and N,N-dioleylsebacic amide; aromatic bisamides such as m-xylene-bis-stearic amide and N,N-distearyl isophthalic amide; fatty acid metal salts (generally called as metal soaps) such as calcium stearate, calcium laurate, zinc stearate and magnesium stearate, and waxes obtained by grafting a vinyl monomer such as styrene and acrylic acid to aliphatic hydrocarbon waxes; and partial esterification products of fatty acids with polyalcohols such as behenic acid monoglyceride, and hydroxy group-containing methyl ester compounds obtained by hydrogenation of vegetable oil.

The melting point of the wax which is defined as the peak temperature of the highest endothermic peak during rising temperature on a differential scanning calorimeter (DSC) is preferably from 70 to 140° C. When the melting point is 70° C. or higher, the viscosity of the magnetic toner can be easily maintained and the magnetic toner tends to retain charge and can easily maintain the development efficiency upon long term use. When the melting point is 140° C. or lower, the magnetic toner tends to have improved low-temperature fixability.

The "melting point" of the wax is measured on a differential scanning calorimeter (DSC), DSC-7 (PerkinElmer Inc.), according to ASTM D3418-82.

The measurement sample (10 mg) is precisely weighed.

The sample is placed in an aluminum pan. Using an empty aluminum pan as the reference, the measurement is performed at a rate of temperature rise of 10° C./min in the measurement temperature range from 30 to 200° C. under normal temperature and normal humidity conditions.

During second cycle of rising temperature, the highest endothermic peak is obtained in the temperature range from 40 to 100° C., which peak temperature is used as the melting point of the wax.

The amount of the wax in the magnetic toner is preferably, relative to 100 mass parts of the binder resin, 0.1 mass parts to 20 mass parts and more preferably 0.5 mass parts to 10 mass parts.

The wax can be included in the binder resin by adding the wax while stirring a resin solution in a solvent while raising the temperature thereof during resin production or by adding the wax during melt-kneading during magnetic toner production.

The magnetic toner of the present invention preferably contains the magnetic powder described hereinbelow and has magnetic properties within specific ranges. Namely, in the present invention, the magnetic toner has a saturation magnetization $\sigma s$ at a measurement magnetic field of 795.8 kA/m of 35 $Am^2/kg$ to 45 $Am^2/kg$ and the residual magnetization $\sigma r$ of 1.0 $Am^2/kg$ to 3.0 $Am^2/kg$. The magnetic properties of the magnetic toner can be appropriately adjusted by magnetic properties and amount of the magnetic powder.

The magnetic powder which is used for the magnetic toner according to the present invention contains iron oxide such as triiron tetraoxide and $\gamma$-iron oxide as a main component and may contain phosphorous, cobalt, nickel, copper, magnesium, manganese, aluminum, silicon and the like elements. Particularly, the magnetic powder containing phosphorous and silicon is preferable because the magnetic properties can be further easily adjusted. The magnetic powder preferably has a BET specific surface area according to the nitrogen adsorption method of 2 $m^2/g$ to 30 $m^2/g$ and more preferably 3 $m^2/g$ to 20 $m^2/g$. The magnetic powder preferably has the Mohs hardness of 5 to 7.

The magnetic powder suitably has a spherical, polyhedral, hexahedral or the like shape in view of that the adjustment to the magnetic properties which are suitable for the present invention is easily carried out. The shape of the magnetic powder can be verified with a scanning electron microscope (SEM) or a transmission electron microscope (TEM). When there is a distribution in the shape, the shape of the magnetic powder is defined as the most frequent shape among the existing shapes.

The magnetic powder of the present invention preferably has, in view of that the magnetic properties of the magnetic toner is adjusted, has a saturation magnetization $\sigma s$ at a measurement magnetic field of 795.8 kA/m of 75 $Am^2/kg$ to 85 $Am^2/kg$, more preferably 77 $Am^2/kg$ to 83 $Am^2/kg$. On the other hand, the magnetic powder preferably has a residual magnetization σr at a measurement magnetic field of 795.8 kA/m of 1.5 $Am^2/kg$ to 5.0 $Am^2/kg$ and more preferably 2.0 $Am^2/kg$ to 4.5 $Am^2/kg$.

The magnetic powder preferably has a volume-average particle diameter of 0.05 μm to 0.40 μm inv view of obtaining both sufficient black chromaticity and tinting strength.

The volume-average particle diameter of the magnetic powder can be measured with a transmission electron microscope. Specifically, the magnetic toner particles to be observed are thoroughly dispersed in an epoxy resin, which is then cured in the atmosphere of temperature of 40° C. for 2 days to obtain a cured article. A thin sliced sample is obtained from the cured article using a microtome and observed with a transmission electron microscope (TEM) to acquire a photograph at 10,000- or 40.000-fold magnification. The diameter for 100 magnetic powder particles in the field is measured. Based on the circle-equivalent diameters equivalent to the projected areas of the magnetic powder, the volume-average particle diameter is calculated. The particle diameter can also be measured using an image analyzer.

In the present invention, the saturation magnetization σs and the residual magnetization σr of the magnetic powder and the magnetic toner are measured on a vibrating magnetometer VSM P-1-10 (Toei Industry Co., Ltd.) at a room temperature of 25° C. and an external magnetic field of 795.8 kA/m.

The content of the magnetic powder is preferably, relative to 100 mass parts of the binder resin, 40 mass parts to 150 mass parts, more preferably 50 mass parts to 120 mass parts and particularly preferably 60 mass parts to 110 mass parts in view of controlling the magnetic properties and the distribution of the charge amount of the magnetic toner of the present invention.

The content of the magnetic powder in the magnetic toner can be measured with a thermal analyzer TGA7 from PerkinElmer Inc. With regard to the measurement method, the magnetic toner is heated from normal temperature to 900° C. under a nitrogen atmosphere at a rate of temperature rise of 25° C./minute, the mass loss from 100° C. to 750° C. is taken to be the amount of the binder resin and the residual mass is approximately taken to be the amount of the magnetic powder.

The magnetic toner according to the present invention may be added with a charge control agent if necessary in order to improve the charge property. In the present invention, as the magnetic toner has negative charging property, it is preferable to add a charge control agent having negative charging property. The charge control agent having negative charging property is advantageously, for example, organic metal complexes and chelate compounds which may specifically include monoazo metal complexes; acetyl acetone metal complexes; metal complexes of aromatic hydroxycarboxylic acid or aromatic dicarboxylic acid and metal salts, anhydrides, esters and phenol derivatives thereof such as bisphenols.

Specific examples of the charge control agent having negative charging property may include, for example, Spilon Black TRH, T-77 and T-95 (Hodogaya Chemical Co., Ltd.) and BONTRON® S-34, S-44, S-54, E-84, E-88 and E-89 (Orient Chemical Industries Co., Ltd.).

One of these charge control agents or two or more of them in combination can be used. The amount of the charge control agent to be used is preferably, relative to 100 mass parts of the binder resin, 0.1 mass parts to 5.0 mass parts in view of the charge amount of the magnetic toner.

The magnetic toner of the present invention comprises inorganic fine powder for the purpose of improvements in flowability, transfer property and charging stability of the magnetic toner.

The inorganic fine powder which is used for the present invention can be suitably exemplified by silica fine powder, titanium oxide fine powder, alumina fine powder and the like. The inorganic fine powder preferably comprises silica fine powder. The silica fine powder to be used can be, for example, both of dry silica, which is so-called dry or humed silica, produced by vapor phase oxidation of a silicon halide as well as so-called wet silica produced from liquid glass and the like.

The titanium oxide fine powder which can be used is titanium oxide fine powder obtained by the sulfuric acid method, the chlorine method, oxidation at a low temperature (thermal decomposition, hydrolysis) of a volatile titanium compound, e.g., titanium alkoxide, titanium halide and titanium acetylacetonate. Titanium oxide of any crystalline system can be used such as anatase-type, rutile-type, mixed crystal thereof and amorphous.

The inorganic fine powder is preferably subjected to hydrophobic treatment on the surface thereof with a coupling agent, silicone oil or an organosilicon compound. The hydrophobic treatment of the surface of the inorganic fine powder can be exemplified by a method in which the inorganic fine powder is chemically or physically treated with an organosilicon compound which reacts with or is physically adsorbed to the inorganic fine powder.

The amount of the inorganic fine powder to be added is preferably, relative to 100 mass parts of the magnetic toner particles, 0.1 mass parts or more and 8.0 mass parts or less and still more preferably 0.1 mass parts or more and 4.0 mass parts or less.

The inorganic fine powder preferably has a number-average particle diameter (D1) of primary particles of 0.004 μm or more and 0.30 μm or less in view of imparting the flowability. The number-average particle diameter (D1) of primary particles of the inorganic fine powder is measured by using a magnified photograph of the magnetic toner acquired with a scanning electron microscope. Specifically, particle diameters of at least 300 primary particles of the inorganic fine powder are measured and the number-average particle diameter (D1) of the primary particles is obtained by arithmetically averaging the maximum diameters of the primary particles.

The production method of the magnetic toner of the present invention is described hereinbelow, which do not limit the present invention.

The magnetic toner of the present invention is preferably produced by a method comprising the step of adjusting the average circularity which is exemplified by the step of surface modification described hereinbelow. Other steps in the production are not particularly limited and the magnetic toner may be produced by known production methods. First, materials such as the binder resin and the magnetic powder, as well as an optional wax, charge control agent and the like are mixed (step of mixing of starting materials). The obtained mixture is melt-kneaded (step of melt-kneading), cooled and pulverized (step of pulverizing). The obtained pulverized material is optionally subjected to sphering treatment, surface treatment with hot air and classification to obtain magnetic toner particles. The obtained magnetic toner particles are added externally with the inorganic fine powder to produce the magnetic toner. The magnetic toner particles or the magnetic toner of the present invention are more preferably obtained by surface modification with hot air.

The following is an example of the production. In the step of mixing of starting materials for mixing starting materials in order to provide to the step of melt-kneading, materials such as the binder resin and the magnetic powder as well as an optional wax and charge control agent are weighed at certain amounts, combined and mixed in a mixer. Examples of the mixer include a double cone mixer, a V-shaped mixer, a drum mixer, a super mixer, a Henschel mixer and a nauta mixer.

The mixed starting materials for the magnetic toner are melt-kneaded in order to melt the resins and disperse the magnetic powder and the like therein. In the step of melt-kneading, batch-type kneaders such as a pressurized kneader and Banbury mixer and continuous kneaders can be used. Recently, single-screw or twin-screw extruders are mainstream due to their superiority such that they allow continuous production. For example, a twin-screw extruder of the type KTK from Kobe Steel, Ltd., a twin-screw extruder of the type TEM from Toshiba Machine Co., Ltd., a twin-screw extruder from KCK Co., a Ko-kneader from Buss AG and the like are generally used. The resin composition obtained by melt-kneading the starting materials for the magnetic toner is, after melt-kneading, extended by applying pressure on a twin roll and the like and cooled in the step of cooling by water cooling and the like.

The cooled resin composition thus obtained is pulverized in the step of pulverizing so as to obtain a desired particle diameter. In the step of pulverizing, the resin composition is coarsely pulverized with a crasher, a hammer mill, a feather mill or the like and further pulverized with a Kryptron system from Kawasaki Heavy Industries, Ltd., a Super Rotor from Nisshin Engineering Inc. and the like to obtain the pulverized product.

Optionally, classification with a screening classifier including a classifier such as an Elbow Jet (Nittetsu Mining Co., Ltd.) which is an internal classification system or a Turboplex (Hosokawa Micron Corporation) which is a centrifugal classification system may follow to obtain the classified product.

Figure 3:
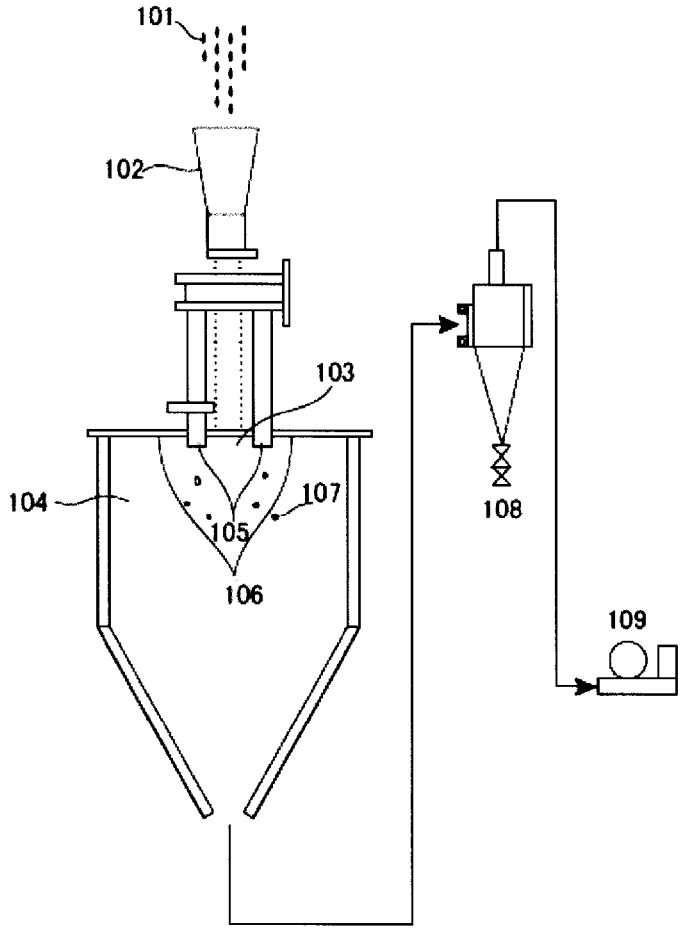
FIG. 3 is a schematic diagram of a surface modification apparatus.

The magnetic toner particles which are used for the present invention are preferably obtained by subjecting the above pulverized product to surface treatment with hot air using a surface treatment apparatus shown in FIG. 3 followed by classification. Alternatively, the previously classified product may preferably be subjected to surface treatment with hot air using a surface treatment apparatus shown in FIG. 3.

The step of surface modification with hot air which is preferably carried out according to the present invention is described with the specific example hereinbelow. Surface modification of the magnetic toner particles or the magnetic toner can be carried out by using a surface modification apparatus shown in FIG. 3, for example. The magnetic toner particles 101 are fed into the surface modification apparatus 104 at a constant amount from an autofeeder 102 through a feeding nozzle 103. As the surface modification apparatus 104 is internally vacuumed with a blower 109, the magnetic toner particles 101 introduced through the feeding nozzle 103 are dispersed in the apparatus. Heat is instantly applied to the thus dispersed magnetic toner particles 101 by means of hot air introduced from a hot air inlet 105, so that they are surface-modified. Hot air is generated by a heater in the present invention; however, the device is not particularly limited as long as it can generate hot air sufficient for surface modification of the magnetic toner particles. The surface-modified magnetic toner particles 107 are instantly cooled by means of cool wind introduced from a cool wind inlet 106. Liquid nitrogen is used as cool wind in the present invention; however, the means is not particularly limited as long as it can instantly cool the surface-modified magnetic toner particles 107. The surface-modified magnetic toner particles 107 are vacuumed with the blower 109 and collected in a cyclone 108.

Hot air used in the step of surface modification for the magnetic toner of the present invention is preferably 160° C. or higher and 450° C. or lower. Hot air at 160° C. or higher can improve surface tension easily. Hot air at 450° C. or lower can easily suppress aggregation of the magnetic toner particles.

Optionally, further surface modification and sphering treatment may be carried out by using, for example, a Hybridization System from Nara Machinery Co., Ltd. or a Mechanofusion system from Hosokawa Micron Corporation. In such a case, a screening classifier may be optionally used such as a High Bolter (Shin Tokyo Kikai Co., Ltd.) which is an air sifter.

On the other hand, the magnetic toner particles may be externally added with the inorganic fine powder by, for example, combining the classified magnetic toner particles and the inorganic fine powder at predetermined amounts and stirring and mixing them using an external addition apparatus such as a high-speed stirrer applying shear force to powder e.g., a Henschel mixer, a super mixer and the like. When the magnetic toner is subjected to surface treatment with hot air, the inorganic fine powder can be externally added before and/or after hot air treatment. External addition is preferably carried out before hot air treatment because the reduction rate of the silicon element upon soaking the magnetic toner in an alkaline aqueous solution can be easily decreased, which is a preferable embodiment of the present invention.

As described above, the present invention relates to a developing apparatus comprising an electrostatic latent image bearing member on which an electrostatic latent image is formed, a magnetic toner for developing the electrostatic latent image, a magnetic toner-carrying member arranged so as to oppose the electrostatic latent image bearing member for carrying and transporting the magnetic toner, and a toner regulating member contacting the magnetic toner-carrying member and regulating the magnetic toner carried on the magnetic toner-carrying member. The developing apparatus of the preset invention is characterized in that the work function value at the surface of the magnetic toner-carrying member is within a specific range, the toner regulating member contains a polyphenylene sulfide or a polyolefin at a portion contacting the magnetic toner and it comprises the magnetic toner of the present invention.

The developing apparatus of the present invention is described in detail hereinbelow by means of figures, which do not limit the present invention.

Figure 2:
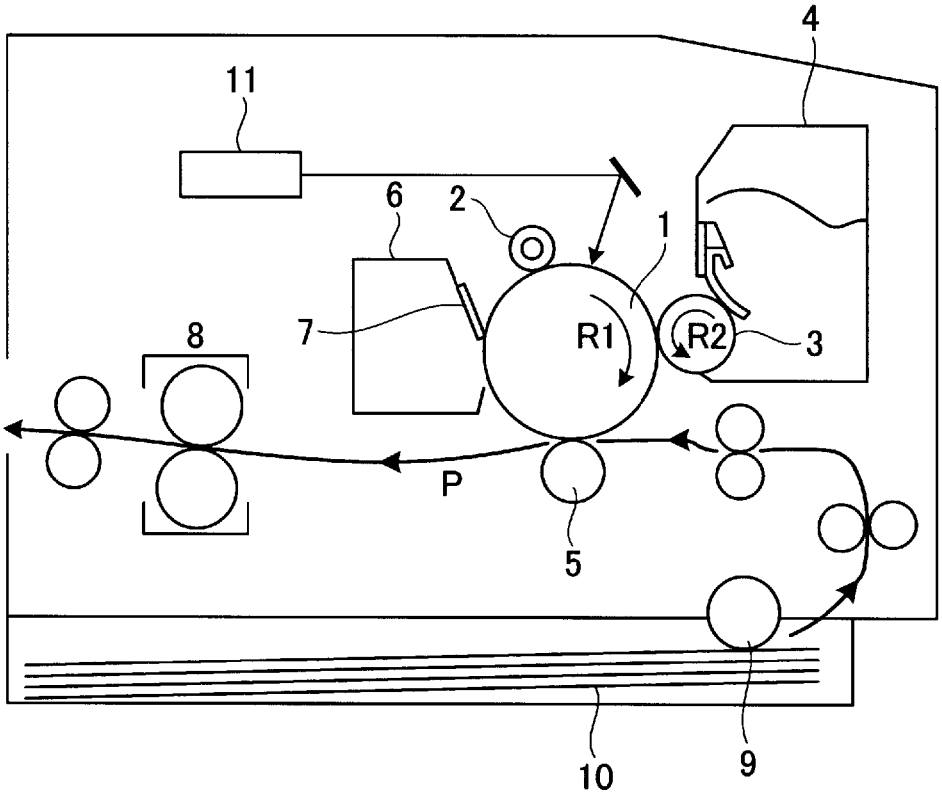
FIG. 2 is a section diagram that shows an example of an image-forming apparatus.
Figure 4:
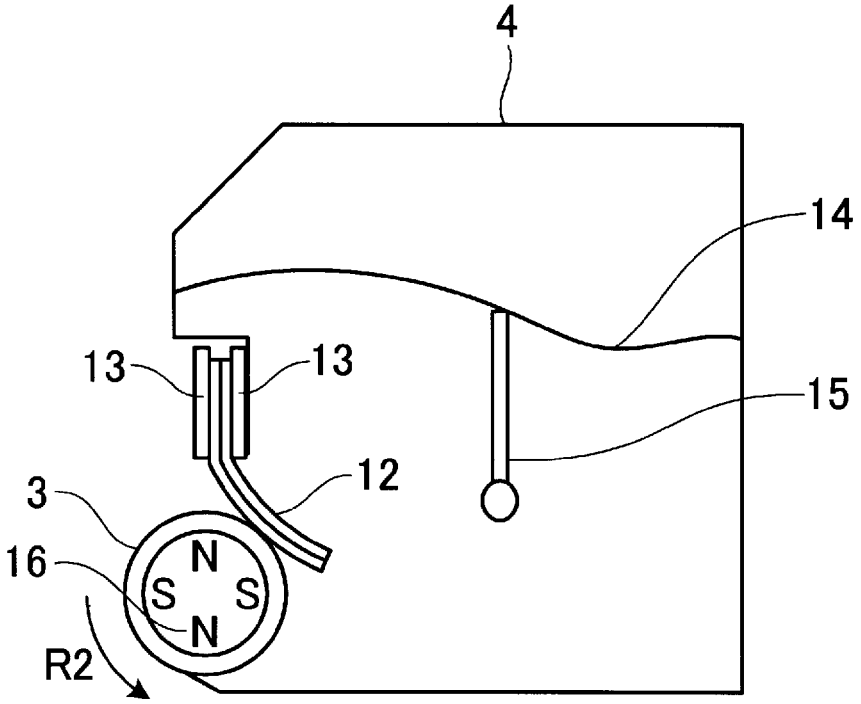
FIG. 4 is a section diagram that shows an example of a developing apparatus.

FIG. 4 is a section diagram that shows an example of the developing apparatus of the present invention. FIG. 2 is a section diagram that shown an example of the image-forming apparatus containing the developing apparatus of the present invention.

In FIG. 2 or 4, an electrostatic latent image bearing member (photosensitive member) 1 which is the image bearing member onto which an electrostatic latent image has been formed rotates along the direction of the arrow R1. A magnetic toner-carrying member 3 carries magnetic toner 14 in a developing device 4 and rotates along the direction of the arrow R2, so that the magnetic toner 14 is transported to a developing zone where the magnetic toner-carrying member 3 opposes to the electrostatic latent image bearing member (photosensitive member) 1. In the magnetic toner-carrying member 3, a magnet 16 is provided in order to magnetically attract and retain the magnetic toner on the magnetic toner-carrying member 3.

A charging roller 2, a transfer member (transfer roller) 5, a cleaner container 6, a cleaning blade 7, a fixing unit 8, a pick-up roller 9 and the like are disposed on the circumference of the electrostatic latent image bearing member (photosensitive member) 1. The electrostatic latent image bearing member (photosensitive member) 1 is charged by the charging roller 2. Photoexposure is performed by irradiating the electrostatic latent image bearing member (photosensitive member) 1 with laser light from a laser generator 11 to form an electrostatic latent image corresponding to the intended image. The electrostatic latent image on the electrostatic latent image bearing member (photosensitive member) 1 is developed with the magnetic toner in the developing device 4 to provide a toner image. The toner image is transferred onto a transfer material (paper) 10 by the transfer member (transfer roller) 5, which contacts the electrostatic latent image bearing member (photosensitive member) 1 with the transfer material interposed therebetween. The transfer material (paper) 10 containing the toner image is conveyed to the fixing unit 8 and fixing on the transfer material (paper) 10 is carried out. In addition, the magnetic toner 14 remaining to some extent on the electrostatic latent image bearing member (photosensitive member) 1 is scraped off by the cleaning blade 7 and stored in the cleaner container 6.

In the step of charging carried out in the developing apparatus of the present invention, a contact charging apparatus is preferably used in which the electrostatic latent image bearing member contacts a charging roller by forming a contact portion and certain charging bias is applied to the charging roller to charge the surface of the electrostatic latent image bearing member at a desired polarity and potential. Such contact charging allows stable and uniform charging and can decrease the amount of ozone generated.

However, when a fixed type charging member is used, it is difficult to keep uniform contact between the charging member and the rotating electrostatic latent image bearing member, resulting in frequent generation of charge non-uniformity. In order to keep uniform contact with the electrostatic latent image bearing member and obtain uniform charging, the charging roller preferably rotates in the same direction as the electrostatic latent image bearing member.

Preferable process conditions when the charging roller is used can be exemplified by the contact pressure of the charging roller: 4.9 to 490.0 N/m (5.0 to 500.0 g/cm); and DC voltage or AC and DC superposed voltage. When AC voltage is superposed, it is preferable that AC voltage is 0.5 to 5.0 kVpp, the frequency of AC is 50 to 5 kHz, and DC voltage has the absolute value of 200 to 1500 V. The polarity of voltage depends on the developing apparatus to be used.

The waveform of AC voltage used in the step of charging may be a sinusoidal wave, a square wave, a triangular wave and the like.

The material of an elastomer used for the charging roller may include, but not limited to, rubber materials obtained by dispersing a conductive substance such as carbon black or metal oxides in ethylene-propylene-diene rubbers (EPDMs), urethanes, butadiene acrylonitrole rubbers (NBRs), silicon rubbers, isoprene rubbers and the like in order to adjust the resistance and foamed materials thereof. It is also possible to adjust the resistance without dispersing the conductive substance or by using the conductive substance in combination with an ion conductive material.

A cored bar of the charging roller may include aluminum, SUS and the like. The charging roller is provided by pressing it against a member to be charged, i.e., the electrostatic latent image bearing member, at predetermined pressing pressure against elasticity, so that a charging contact portion is formed which is a contact portion between the charging roller and the electrostatic latent image bearing member.

The step of contact transfer which is preferably applied to the developing apparatus of the present invention is now specifically described. In the step of contact transfer, the electrostatic latent image bearing member contacts with the transfer member with the recording medium interposed therebetween, thereby electrostatically transferring a toner image to the recording medium. The contact pressure of the transfer member is preferably, as linear pressure, 2.9 N/m (3.0 g/cm) or more and more preferably 19.6 N/m (20.0 g/cm) or more. When the contact pressure as linear pressure is less than 2.9 N/m (3.0 g/cm), a shift upon transport of the recording medium and defective transfer tend to occur.

The developing apparatus of the present invention to which contact transfer is applied is particularly advantageously used for an image-forming apparatus containing an electrostatic latent image bearing member having a small diameter such as 50 mm or less. Namely, the electrostatic latent image bearing member having a small diameter has a large curvature against the same linear pressure and pressure tends to be concentrated on the contact portion. The same phenomenon may happen with the electrostatic latent image bearing member having a belt shape. The present invention is also effective for an image-forming apparatus having a curvature radius of 25 mm or less at a transfer portion.

In the developing apparatus of the present invention, in order to obtain high image quality without fogging, it is preferable that magnetic toner is applied on the magnetic toner-carrying member at a thickness thinner than the distance of the closest approach (between S-D) between the magnetic toner-carrying member and the electrostatic latent image bearing member and the applied magnetic toner is used for development of an electrostatic latent image in the step of development.

Generally known regulating members for regulating magnetic toner on magnetic toner-carrying members include a magnetic cutting means and a regulating blade, among which a regulating blade is preferably used in the present invention. It is easy for the regulating blade to contain a polyphenylene sulfide or a polyolefin at a portion contacting the magnetic toner as described above.

In the present invention, the regulating member may be an article in the form of sheet obtained by molding a polyphenylene sulfide or a polyolefin as it is. Alternatively, it may be suitably a metal substrate (metal elastic body) onto which the resin is adhered or coated.

The polyolefin may be a polypropylene or a polyethylene and specifically Novatec PP FW4BT (Japan Polypropylene Corporation) and Thermorun 3855 (Mitsubishi Chemical Corporation) may be suitably used. The polyphenylene sulfide may be suitably Torelina (Toray Industries, Inc.). The toner regulating member is preferably the one obtained by bonding on a metal elastic body a polyolefin film (polypropylene film, polyethylene film etc.) or a polyphenylene sulfide film.

The polyphenylene sulfide and the polyolefin may contain other resins or additives at the level of 20 mass % or less in order to adjust the charging property and the like.

The contact pressure between the regulating member and the magnetic toner-carrying member is preferably, expressed as linear pressure in the generator direction of the magnetic toner-carrying member, 4.9 to 118.0 N/m (5 to 120 g/cm). When the contact pressure is lower than 4.9 N/m, it is difficult to uniformly apply the magnetic toner, which may cause fogging or spots around line images. On the other hand, when the contact pressure is higher than 118.0 N/m, high pressure is applied to the magnetic toner, which may cause deterioration of the magnetic toner.

The magnetic toner layer is preferably formed on the magnetic toner-carrying member at 7.0 g/m$^2$ or more and 18.0 g/m$^2$ or less. When the amount of the magnetic toner on the magnetic toner-carrying member is less than 7.0 g/m$^2$, sufficient image density may not be obtained. The reason for this is as follows: the amount of the magnetic toner developed on the electrostatic latent image bearing member is determined by [the amount of the magnetic toner on the magnetic toner-carrying member]×[the ratio of circumferential velocity of the magnetic toner-carrying member to that of the electrostatic latent image bearing member]×[development efficiency]; however, when the amount of the magnetic toner on the magnetic toner-carrying member is low, enough amount of the magnetic toner is not developed no matter how high the development efficiency is.

On the other hand, when the amount of the toner on the magnetic toner-carrying member is higher than 18.0 g/m$^2$, it may appear that enough image density could be obtained even when the development efficiency is low. However, it in fact tends to make uniform charging of the magnetic toner difficult and therefore the development efficiency is not sufficiently increased and sufficient image density may not be obtained. In addition, because uniform charging property is deteriorated, the transfer property is decreased as well as fogging may be increased.

In the present invention, the amount of the magnetic toner on the magnetic toner-carrying member can be appropriately changed by changing the surface roughness (RaS) of the magnetic toner-carrying member, the free length of the regulating member or the contact pressure of the regulating member. The amount of the magnetic toner on the magnetic toner-carrying member is measured as follows: a cylindrical filter paper is attached at a suction nozzle having an outer diameter of 6.5 mm, which is then attached to a vacuum cleaner to vacuum the magnetic toner on the magnetic toner-carrying member. The vacuumed amount of the magnetic toner (g) is divided by the vacuumed area (m$^2$) to obtain the amount of the magnetic toner on the magnetic toner-carrying member.

The magnetic toner-carrying member which is used for the present invention is preferably a conductive cylindrical article made of metal or metal alloy such as aluminum, stainless steel and the like. The conductive cylindrical article may be made of a resin composition having sufficient mechanical strength and conductivity or may be a conductive rubber roller.

The magnetic toner-carrying member which is used for the present invention preferably contains a multipolar magnet fixed therein and the number of magnetic poles is preferably 3 to 10.

In the present invention, the step of development is preferably the step of applying an alternating electric field as developing bias onto the magnetic toner-carrying member, thereby transferring the magnetic toner to an electrostatic latent image on the electrostatic latent image bearing member to form a magnetic toner image. The developing bias to be applied may be DC voltage superposed with the alternating electric field.

The waveform of the alternating electric field may be a sinusoidal wave, a square wave, a triangular wave and the like as desired. It may be a wave pulse formed by periodically turning on/off an DC power supply. Accordingly, the waveform of the alternating electric field used may be a bias having the voltage value which alters periodically.

The developing method of the present invention is a method for developing an electrostatic latent image formed on an electrostatic latent image bearing member using magnetic toner that is carried on a magnetic toner-carrying member arranged so as to oppose the electrostatic latent image bearing member and that is regulated by a toner regulating member contacting the magnetic toner-carrying member, wherein:

the magnetic toner-carrying member has a work function value at the surface of 4.6 eV or more and 4.9 eV or less, the toner regulating member contains a polyphenylene sulfide or a polyolefin at a portion contacting the magnetic toner, and the magnetic toner i) comprises magnetic toner particles, each of which contains a binder resin and magnetic powder, and inorganic fine powder, ii) has negative charging property, iii) has an average circularity of 0.950 or more, and iv) has a surface tension index I for a 45 volume % aqueous solution of methanol measured by the capillary suction time method and calculated by the following equation (1) of 5.0×10$^{-3}$ N/m or more and 1.0×10$^{-1}$ N/m or less:

$$I=P\alpha/(A\times B\times 10^6) \quad (1)$$

wherein in the equation (1), I represents the surface tension index (N/m) of the magnetic toner; Pα represents a capillary pressure (N/m$^2$) of the magnetic toner for the 45 volume % aqueous solution of methanol; A represents a specific surface area (m$^2$/g) of the magnetic toner; and B represents a true density (g/cm$^3$) of the magnetic toner.

The methods of measuring various physical properties according to the present invention are now described.

<Method of Measuring Weight-Average Particle Diameter (D4) of Magnetic Toner>

The weight-average particle diameter (D4) of the magnetic toner is calculated as follows. The measurement instrument used is a "Coulter Counter Multisizer 3" (registered trademark, Beckman Coulter, Inc.), a precision particle size distribution measurement instrument operating on the pore electrical resistance principle and equipped with a 100 μm aperture tube. The measurement conditions are set and the measurement data are analyzed using the accompanying dedicated software, i.e., "Beckman Coulter Multisizer 3 Version 3.51" (Beckman Coulter, Inc.). The measurements are carried at 25,000 channels for the number of effective measurement channels.

The aqueous electrolyte solution used for the measurements is prepared by dissolving special-grade sodium chloride in ion-exchanged water to provide a concentration of approximately 1 mass % and, for example, "ISOTON II" (Beckman Coulter, Inc.) can be used.

The dedicated software is configured as follows prior to measurement and analysis.

In the "modify the standard operating method (SOM)" screen of the dedicated software, the total count number in the control mode is set to 50,000 particles; the number of measurements is set to one time; and the Kd value is set to the value obtained using "standard particle 10.0 μm" (Beckman Coulter, Inc.). The threshold value and noise level are automatically set by pressing the "threshold value/noise level measurement button". In addition, the current is set to 1600 μA; the gain is set to 2; the electrolyte is set to ISOTON II; and a check is entered for the "post-measurement aperture tube flush".

In the "setting conversion from pulses to particle diameter" screen of the dedicated software, the bin interval is set to logarithmic particle diameter; the particle diameter bin is set to 256 particle diameter bins; and the particle diameter range is set to 2 μm to 60 μm.

The specific measurement procedure is as follows.

(1) Approximately 200 mL of the above-described aqueous electrolyte solution is introduced into a 250-mL round bottom glass beaker intended for use with the Multisizer 3 and this is placed in the sample stand and counterclockwise stirring with the stirrer rod is carried out at 24 rotations per second. Contamination and air bubbles within the aperture tube have previously been removed by the "aperture flush" function of the dedicated software.

(2) Approximately 30 mL of the above-described aqueous electrolyte solution is introduced into a 100-mL flat bottom glass beaker. To this is added as dispersant approximately 0.3 mL of a dilution prepared by the approximately three-fold (mass) dilution with ion-exchanged water of "Contaminon N" (a 10 mass % aqueous solution of a neutral pH 7 detergent for cleaning precision measurement instrumentation, comprising a nonionic surfactant, anionic surfactant and organic builder, from Wako Pure Chemical Industries, Ltd.).

(3) An "Ultrasonic Dispersion System Tetora 150" (Nikkaki Bios Co., Ltd.) is prepared; this is an ultrasound disperser with an electrical output of 120 W and is equipped with two oscillators (oscillation frequency=50 kHz) disposed such that the phases are displaced by 180°. Approximately 3.3 L of ion-exchanged water is introduced into the water tank of this ultrasound disperser and approximately 2 mL of Contaminon N is added to the water tank.

(4) The beaker described in (2) is set into the beaker holder opening on the ultrasound disperser and the ultrasound disperser is started. The height of the beaker is adjusted in such a manner that the resonance condition of the surface of the aqueous electrolyte solution within the beaker is at a maximum.

(5) While the aqueous electrolyte solution within the beaker set up according to (4) is being irradiated with ultrasound, approximately 10 mg of magnetic toner is added to the aqueous electrolyte solution in small aliquots and dispersion is carried out. The ultrasound dispersion treatment is continued for an additional 60 seconds. The water temperature in the water bath is controlled as appropriate during ultrasound dispersion to be 10° C. or higher and 40° C. or lower.

(6) Using a pipette, the dispersed magnetic toner-containing aqueous electrolyte solution prepared in (5) is dripped into the round bottom beaker set in the sample stand as described in (1) with adjustment to provide a measurement concentration of approximately 5%. Measurement is then performed until the number of measured particles reaches 50,000.

(7) The measurement data is analyzed by the above dedicated software provided with the instrument and the weight-average particle diameter (D4) is calculated. When set to graph/volume % with the dedicated software, the "average diameter" on the "analysis/volumetric statistical value (arithmetic average)" screen is the weight-average particle diameter (D4).

<Method of Measuring Average Circularity and Aspect Ratio of Magnetic Toner>

The average circularity of the magnetic toner is measured with the "FPIA-3000" (Sysmex Corporation), a flow particle imaging analyzer, using the measurement and analysis conditions from the calibration process.

The specific measurement method is as follows. First, approximately 20 mL of ion-exchanged water from which the solid impurities and so forth have previously been removed is placed in a glass container. To this is added as dispersant approximately 0.2 mL of a dilution prepared by the approximately three-fold (mass) dilution with ion-exchanged water of "Contaminon N" (a 10 mass % aqueous solution of a neutral pH 7 detergent for cleaning precision measurement instrumentation, comprising a nonionic surfactant, anionic surfactant and organic builder, from Wako Pure Chemical Industries, Ltd.). Approximately 0.02 g of the measurement sample is also added and a dispersion treatment is carried out for 2 minutes using an ultrasound disperser to provide a dispersion for submission to measurement. Cooling is carried out as appropriate during this treatment so as to provide a dispersion temperature of 10° C. or higher and 40° C. or lower. The ultrasound disperser used here is a benchtop ultrasonic cleaner/disperser that has an oscillation frequency of 50 kHz and an electrical output of 150 W (for example, a "VS-150" from Velvo-Clear Co., Ltd.); a predetermined amount of ion-exchanged water is introduced into the water tank and approximately 2 mL of the aforementioned Contaminon N is also added to the water tank.

The previously cited flow-type particle image analyzer fitted with an objective lens "UPlanApro" (10-fold magnification, numerical aperture: 0.40) is used for the measurement, and Particle Sheath "PSE-900A" (Sysmex Corporation) is used for the sheath solution. The dispersion prepared according to the procedure described above is introduced into the flow-type particle image analyzer and 3000 magnetic toner particles are measured according to total count mode in HPF measurement mode. The average circularity of the magnetic toner is determined with the binarization threshold value during particle analysis set at 85% and the analyzed particle diameter limited to a circle-equivalent diameter of 1.985 μm or more and less than 39.69 μm.

The aspect ratio and the aspect ratio standard deviation are determined with the limited circle-equivalent diameter of 0.5 μm or more and less than 20.0 μm.

For this measurement, automatic focal point adjustment is performed prior to the start of the measurement using reference latex particles (for example, a dilution with ion-exchanged water of "RESEARCH AND TEST PARTICLES Latex Microsphere Suspensions 5200A" from Duke Scientific). After this, focal point adjustment is preferably performed every 2 hours after the start of measurement.

In the Examples of the present application, the flow-type particle image analyzer used had been calibrated by the Sysmex Corporation and had been issued with a calibration certificate by the Sysmex Corporation. The measurements are carried out under the same measurement and analysis conditions as when the calibration certificate was received, with the exception that the analyzed particle diameter is limited to a circle-equivalent diameter of 1.985 μm or more and less than 39.69 μm.

<Method of Measuring Melting Point (Peak Temperature of the Highest Endothermic Peak) of Wax>

The melting point (peak temperature of the highest endothermic peak) of the wax is measured based on ASTM D3418-82 using a "Q1000" differential scanning colorimeter (DSC) (TA Instruments, Inc.).

Temperature correction in the instrument detection section is carried out using the melting points of indium and zinc, while the heat of fusion of indium is used to correct the amount of heat.

Specifically, approximately 10 mg of wax is precisely weighed out and this is introduced into an aluminum pan. Using an empty aluminum pan as the reference, the measurement is performed at a rate of temperature rise of 10° C./min in the measurement temperature range from 30° C. to 200° C. For the measurement, the temperature is raised to 200° C. and is then dropped to 30° C. and is thereafter raised again. The peak temperature of the highest endothermic peak is defined as the melting point of the wax from the DSC curve in the temperature range of 30° C. to 200° C. for this second temperature ramp-up step.

<Method of Measuring Tetrahydrofuran-Insoluble Fraction of Magnetic Toner>

The magnetic toner (approximately 1.5 g) is weighed (W1 g) and placed in a cylindrical filter paper (e.g., trade name No. 86R (outer diameter 28 mm×full length 100 mm), Toyo Roshi Kaisha, Ltd.) previously weighed, which is then placed in a Soxhlet extraction apparatus. A solvent, 200 mL of tetrahydrofuran (THF), is used for extraction for 10 hours. The extraction is carried out with a reflux speed such that the extraction by the solvent is carried out once about 5 minutes.

After extraction, the cylindrical filter paper is recovered, air dried, dried under vacuum at 40° C. for 8 hours and weighed for the mass including the extraction remaining, from which the mass of the cylindrical filter paper is subtracted to calculate the mass (W2 g) of the extraction remaining.

Next, the content (W3 g) of the components other than resin components is determined as follows. In a 30-ml magnetic crucible which has been previously weighed, approximately 2 g of magnetic toner is weighed (Wa g). The crucible is placed in an electric furnace and heated at approximately 900° C. for approximately 3 hours, left to cool in the electric furnace, left to cool in a desiccator at normal temperature for more than an hour and weighed for a mass including burned remaining ash, from which the mass of the crucible is subtracted to calculate the burned remaining ash (Wb g). The mass (W3 g) of the burned remaining ash in W1 g of the sample is calculated from the following equation (1).

$$W3=W1\times(Wb/Wa) \quad (1)$$

In this case, the tetrahydrofuran-insoluble fraction can be determined from the following equation (2).

$$\text{Tetrahydrofuran-insoluble fraction(mass \%)}=\{(W2-W3)/(W1-W3)\}\times 100 \quad (2)$$

<Reduction Rate of Silicon Element in Alkaline Aqueous Solution>

(1) To 15 g of the magnetic toner are added 400 ml of a 1 mol/L NaOH aqueous solution and approximately 1 ml of an approximately three-fold (mass) diluted solution of "Contaminon N" in ion-exchanged water. The magnetic toner is dispersed by ultrasonication for 10 minutes.

(2) The dispersion is further stirred at 50° C. for 30 minutes.

(3) The stirred solution is centrifuged at 10,000 rpm for 10 minutes and the supernatant is removed.

(4) The remaining solid after separation of the supernatant is added with a 1 mol/L NaOH aqueous solution, dispersed by ultrasonication for 5 minutes and centrifuged for 10 minutes to remove the supernatant.

(5) The remaining solid after separation of the supernatant is added with ion-exchanged water, dispersed by ultrasonication for 5 minutes and centrifuged.

(6) The supernatant is drained and the solid is dried.

(7) On an X-ray fluorescence spectrometer, the dried matter obtained in (6) and the magnetic toner are quantified for the amount of Si, and the reduction rate of the silicon element is calculated from the obtained results. It is defined herein that the silicon element reduced is derived from silica, which corresponds to the inorganic fine powder.

The above measurement using an X-ray fluorescence spectrometer is based on JIS K 0119-1969 and is specifically as follows.

The measurement instrument used is an "Axios" (PANalytical), a wavelength-dispersive X-ray fluorescence spectrometer and the accompanying dedicated software "SuperQ ver. 4.0F" (PANalytical) for setting the measurement conditions and analysis of the measurement data. An anode of the X-ray tube is Rh, measurement atmosphere is under vacuum, the measurement diameter (collimator mask diameter) is 27 mm and the measurement duration is 10 seconds. Alight element and a heavy element are detected on a proportional counter (PC) and a scintillation counter (SC), respectively.

A measurement sample is a molded pellet having a thickness of approximately 2 mm and a diameter of approximately 39 mm obtained by introducing approximately 4 g of the toner into a dedicated aluminum ring for pressing, flatting it out and pressing it on a tablet molding press "BRE-32" (Maekawa Testing Machine Mfg. Co., Ltd.) at 20 MPa for 60 seconds. The measurement is performed with the above conditions, elements are identified based on the peak positions of the obtained X-ray and the concentration thereof is calculated from the count rate (unit: cps) which indicates the number of X-ray photons per unit time.

To 100 mass parts of the magnetic toner is added 0.10 mass parts of silica ($SiO_2$) fine powder and thoroughly mixed with a coffee mill. In a similar manner, the magnetic toner is mixed with 0.20 mass parts and 0.50 mass parts of silica fine powder, respectively, to obtain samples for a calibration curve.

From each sample, pellets of samples for a calibration curve are prepared with the tablet molding press in the manner described above and the count rate (unit: cps) of the Si—Kα line observed at the diffraction angle (2θ)=109.08° when pentaerythritol (PET) is used as a dispersive crystal is measured. The values of accelerating voltage and current of the X-ray generator on this occasion are 24 kV and 100 mA, respectively. The count rate of X-ray obtained and the amount of $SiO_2$ added to each sample for a calibration curve are plotted on the Y-axis and X-axis respectively to obtain a calibration curve of a linear function. The magnetic toner to be analyzed is then used to prepare pellets as described above with the tablet molding press, from which the count rate of the Si—Kα line is measured. The content of $SiO_2$ in the magnetic toner is then determined based on the calibration curve.

The reduction rate of the silicon element [mass %] is determined from the following equation.

[(The amount of Si in magnetic toner−the amount of Si in the dried matter obtained in(6))/the amount of Si in magnetic toner]×100(%)

<Method of Measuring Surface Tension Index of Magnetic Toner>

The surface tension index of the magnetic toner is measured as follows.

Approximately 5.5 g of the magnetic toner was gently charged in a measurement cell and subjected to a tapping operation on a tapping machine PTM-1 model (Sankyo Pio-Tech Co., Ltd.) at a tapping speed of 30 times/min for 1 minute. The cell was placed in a measurement instrument (Sankyo Pio-Tech Co., Ltd.: WTMY-232A model Wet Tester) for measurement. The capillary pressure $P_\alpha$ ($N/m^2$) was measured by the capillary suction time method. The measurement conditions are as follows.

Solvent: 45 volume % aqueous solution of methanol

Measurement mode: Constant flow rate method (A2 mode)

Liquid flow rate: 2.4 ml/min

Cell: Y-shaped measurement cell

The surface tension index I (N/m) of the magnetic toner was calculated from the following formula (1), wherein $P_\alpha$ ($N/m^2$) is the capillary pressure of the magnetic toner measured by the capillary suction time method, A ($m^2/g$) is the specific surface area of the magnetic toner, and B ($g/cm^3$) is the true density of the magnetic toner. The specific surface area and the true density of the magnetic toner were measured by the methods described below.

$$I=P_\alpha/(A\times B\times 10^6) \quad (1)$$

<Method of Measuring Specific Surface Area (BET Method) of Magnetic Toner>

The specific surface area (BET method) of the magnetic toner was measured on a specific surface area analyzer, Tristar3000 (Shimadzu Corporation).

A nitrogen gas was caused to adsorb to the surface of a sample in accordance with a BET method, and the specific surface area of the magnetic toner was calculated by employing a BET multipoint method. Prior to the measurement of the specific surface area, approximately 2 g of the sample were precisely weighed in a sample tube, and the tube was evacuated to a vacuum at room temperature for 24 hours. After the evacuation to a vacuum, the mass of the entire sample cell was measured, and the exact mass of the sample was calculated from a difference between the measured mass and the mass of an empty sample cell.

Next, the empty sample cell was set in each of the balance port and analysis port of the above measuring apparatus. Next, a Dewar flask containing liquid nitrogen was set at a predetermined position, and a saturated vapor pressure (P0) measurement command was used for measuring a P0. After the completion of the measurement of the P0, the prepared sample cell was set in the analysis port, and the sample mass and the P0 were entered. After that, measurement was initiated by a BET measurement command. After that, the BET specific surface area was automatically calculated.

<Method of Measuring True Density of Magnetic Toner>

The true density of the magnetic toner was measured with a dry automatic densitometer Autopycnometer (Yuasa Ionics Inc.) under the following conditions.

| | |
|---|---|
| Cell | SM cell (10 ml) |
| Sample amount | Approximately 2.0 g |

The measurement apparatus measures the true density of solid or liquid on the basis of a vapor-phase substitution method. The vapor-phase substitution method, which is based on Archimedes' principle as in the case of a liquid-phase substitution method, shows high accuracy because a gas (argon gas) is used as a substitution medium.

<Method of Measuring Work Function Value at the Surface of Magnetic Toner-Carrying Member>

The work function value at the surface of the magnetic toner-carrying member is measured with a photoelectron spectrometer AC-2 [Riken Keiki Co., Ltd.] under the following conditions.

Irradiation energy: 4.2 eV to 6.2 eV
Light intensity: 300 nW
Count time: 10 sec/1 point
Plate voltage: 2900 V

| | |
|---|---|
| Irradiation energy: | 4.2 eV to 6.2 eV |
| Light intensity: | 300 nW |
| Count time: | 10 sec/1 point |
| Plate voltage: | 2900 V |

A measurement specimen is prepared by cutting the magnetic toner-carrying member into the size of 1 cm×1 cm. The specimen is scanned with UV light from 4.2 to 6.2 eV at an interval of 0.05 eV in the order from low to high energy level. Photoelectrons released at this time are counted and the work function value is calculated from the threshold in the quantum efficiency power plots.

Figure 6:
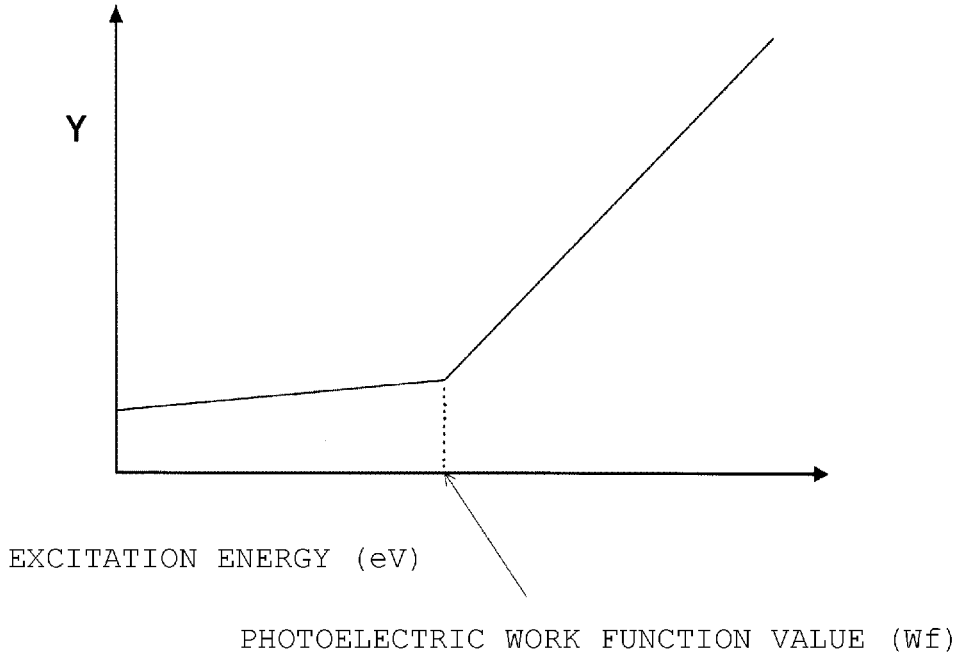
FIG. 6 is a diagram that shows an example of a work function measurement curve.

The work function measurement curve obtained from the measurements under the above conditions is show in FIG. 6. In FIG. 6, the X-axis represents the excitation energy [eV] and the Y-axis represents the value Y which is the 0.5th power of the number of released photoelectrons (normalized photon yield). Generally, when excitation energy exceeds a certain threshold, the amount of released photoelectrons, i.e., the normalized photon yield increases drastically and the work function measurement curve rises sharply. The point of rising is defined as the work function value [Wf].

<Method of Measuring Surface Roughness (RaS) and (RaB)>

The surface roughness (RaS) and (RaB) are based on the surface roughness of JIS B0601 (2001) [specifically, Ra: arithmetic-mean roughness] and are measured using a Surfcorder SE-3500 from Kosaka Laboratory Ltd. The measurement conditions are: cut-off: 0.8 mm, evaluation length: 8 mm and feed speed: 0.5 mm/s.

When the sample is the magnetic toner-carrying member, the average is taken for the measurement results carried out for total nine points which are the central point of the magnetic toner-carrying member and each middle point between the central point and both ends of the coating (total three points), similar three points after rotating the magnetic toner-carrying member for 90 degrees and three points after rotating the magnetic toner-carrying member for further 90 degrees. When the sample is the toner regulating member, the average is taken for the measurement results carried out for five points which are the center, both ends and each middle point between the center and both ends of the portion contacting the magnetic toner-carrying member.

<Method of Measuring Graphitization Degree d (002)>

The graphitized particles are loaded on a non-reflective sample plate and an X-ray diffraction chart is obtained on a horizontal sample mounting high power X-ray diffractometer RINT/TTR-II (trade name) from Rigaku Corporation with a CuKa source. The CuKα ray was monochromatized with a monochromator.

For the lattice spacing d (002) from this X-ray diffraction chart, peak positions of diffraction lines from graphite (002) plane based on the X-ray diffraction spectrum are determined and graphite d (002) is calculated from the Bragg formula (the following formula (2)). The wavelength λ of the CuKα ray is 0.15418 nm.

$$\text{Graphite } d(002)=\lambda/2\sin\theta \quad (2)$$

Measurement Conditions:
Optical system: Parallel beam optical system
Goniometer: Rotor horizontal goniometer (TTR-2)
Tube voltage/current: 50 kV/300 mA
Measurement method: Continuous method
Scanning axis: 2θ/θ
Measurement angle: 10° to 50°
Sampling interval: 0.02°
Scanning speed: 4°/min
Divergence slit: Open
Divergence vertical slit: 10 mm
Scattering slit: Open
Receiving slit: 1.00 mm

EXAMPLES

| | |
|---|---|
| Measurement conditions: | |
| Optical system: | Parallel beam optical system |
| Goniometer: (TTR-2) | Rotor horizontal goniometer |
| Tube voltage/current: | 50 kV/300 mA |
| Measurement method: | Continuous method |
| Scanning axis: | 2θ/θ |
| Measurement angle: | 10° to 50° |
| Sampling interval: | 0.02° |
| Scanning speed: | 4°/min |
| Divergence slit: | Open |
| Divergence vertical slit: | 10 mm |

-continued

| | |
|---|---|
| Scattering slit: | Open |
| Receiving slit: | 1.00 mm |

The present invention is further specifically described by way of Production Examples and Examples herein below, which by no means limit the present invention. Unless otherwise stated, "part(s)" and "%" are in mass basis.

[Production Examples of Magnetic Toner-Carrying Members]

<Production of Magnetic Toner-Carrying Member 1>

β-resins were extracted from coal-tar pitches by solvent fractionation and subjected to hydrogenation and heavy-duty treatment followed by removal of a solvent-soluble fraction with toluene to obtain a mesophase pitch. Powder of the mesophase pitch was finely pulverized and oxidized in air at approximately 300° C. followed by heat treatment in a nitrogen atmosphere at 2800° C. and classification to obtain graphitized particles A having the volume-average particle diameter of 3.4 μm and the graphitization degree p(002) of 0.39.

Next, 100 mass parts equivalent to a solid matter of a resol type phenolic resin (Dainippon Ink & Chemicals, Inc., trade name: J325) obtained by using an ammonium catalyst, 40 mass parts of conductive carbon black A (Degussa, trade name: Special Black 4), 60 mass parts of graphitized particles A and 150 mass parts of methanol were mixed and dispersed in a sand mill in which glass beads having a diameter of 1 mm were used as media particles for 2 hours to obtain an intermediate coating material M1.

The above resol type phenolic resin (50 mass parts equivalent to a solid matter), 30 mass parts of a quaternary ammonium salt (Orient Chemical Industries Co., Ltd., trade name: P-51), 30 mass parts of conductive spherical particles 1 (Nippon Carbon Co., Ltd., trade name: Nicabeads ICB 0520) and 40 mass parts of methanol were mixed and dispersed in a sand mill in which glass beads having a diameter of 2 mm were used as media particles for 45 minutes to obtain an intermediate coating material J1. The intermediate coating material M1 and the intermediate coating material J1 were mixed and stirred to obtain a coating solution B1.

To the coating solution B1 was then added methanol to adjust the solid matter concentration to 38%. A cylindrical tube having an outer diameter of 10 mm and the arithmetic-mean roughness Ra of 0.2 μm made of aluminum obtained by grinding processing was rotated on a rotating stage, applied with a masking on both ends and coated with the coating solution B1 on the surface thereof by descending an air spray gun at a constant velocity to form a conductive resin coat layer. The coating conditions were under the environment of 30° C./35% RH, and the coating was performed by controlling the temperature of the coating solution at 28° C. with a temperature-controlled bath. The conductive resin coat layer was then cured by heating in a hot air drying oven at 150° C. for 30 minutes to prepare a magnetic toner-carrying member 1 having the arithmetic-mean roughness Ra (RaS) of 0.95 μm. The magnetic toner-carrying member 1 was measured for the work function value at the surface to give 4.8 eV.

<Production of Magnetic Toner-Carrying Member 2>

A coating solution B2 was prepared by the same manner as above except that 10 mass parts of conductive carbon black B (Tokai Carbon Co., Ltd., trade name: #5500) was used instead of 40 mass parts of the conductive carbon black A and 90 mass parts of the graphitized particles A were used. The coating solution B2 was used in the same manner as above to prepare a magnetic toner-carrying member 2 having the arithmetic-mean roughness Ra (RaS) of 0.95 μm. The magnetic toner-carrying member 2 was measured for the work function value at the surface to obtain 4.6 eV.

<Magnetic Toner-Carrying Members 3 to 9>

Magnetic toner-carrying members 3 to 9 were obtained in the same manner as the production of the magnetic toner-carrying member 1 except that the formulations shown in Table 1 were used. The compositions of the magnetic toner-carrying members 3 to 9 and physical properties of the obtained magnetic toner-carrying members are shown in Table 1.

TABLE 1

| | | Magnetic toner-carrying member | | | | | | | | |
|---|---|---|---|---|---|---|---|---|---|---|
| | | 1 | 2 | 3 | 4 | 5 | 6 | 7 | 8 | 9 |
| Conductive CB | #5500 | — | 10 mass parts | — | — | — | — | — | — | — |
| | Special Black 4 | 40 mass parts | — | 70 mass parts | 40 mass parts | 40 mass parts | 40 mass parts | 40 mass parts | — | 100 mass parts |
| Metal particles | Silver particles (SPH02J) | — | — | — | — | — | — | — | 30 mass parts | — |
| Graphitized particles A | | 60 mass parts | 90 mass parts | 30 mass parts | 60 mass parts | 60 mass parts | 60 mass parts | 60 mass parts | 90 mass parts | — |
| Spherical particles | ICB0520 | 30 mass parts | 30 mass parts | 30 mass parts | 10 mass parts | — | 5 mass parts | — | 30 mass parts | 30 mass parts |
| | ICB1020 | — | — | — | — | 25 mass parts | — | 30 mass parts | — | — |
| Work function value (eV) | | 4.8 | 4.6 | 4.9 | 4.8 | 4.8 | 4.8 | 4.8 | 4.5 | 5.0 |
| RaS (pm) | | 0.95 | 0.95 | 0.95 | 0.60 | 1.50 | 0.50 | 1.70 | 0.95 | 0.95 |

In the above Table, silver particles (SPHO2J) are from Mitsui Mining & Smelting Co., Ltd. and spherical particles ICB1020 are Nicabeads ICB1020 (trade name) from Nippon Carbon Co., Ltd.

[Production Examples of Binder Resins]

<Production Example of Binder Resin 1>

To a four-neck flask were charged 300 mass parts of xylene and while heating and refluxing, a mixed solution of 78 mass parts of styrene, 22 mass parts of n-butyl acrylate and 2 mass parts of di-tert-butylperoxide was added dropwise over 5 hours to obtain a low molecular weight polymer (L-1) solution.

To another four-neck flask were charged 180 mass parts of degassed water and 20 mass parts of a 2 mass % aqueous solution of polyvinyl alcohol, followed by addition of a mixed solution of 74 mass parts of styrene, 26 mass parts of n-butyl acrylate, 0.005 mass parts of divinylbenzene and 0.1 mass parts of 2,2-bis(4,4-di-tert-butylperoxycyclohexyl)propane (10-hour half-life temperature: 92° C.) and stirring to obtain a suspension. After the interior of the flask was thoroughly replaced with nitrogen, the temperature was raised to 85° C. and polymerization was carried out; after holding for 24 hours, 0.1 mass parts of benzoyl peroxide (10-hour half-life temperature: 72° C.) was added and holding was continued for another 12 hours to finish the polymerization of a high molecular weight polymer (H-1).

To 300 mass parts of the homogeneous solution of the above low molecular weight polymer (L-1) were added 24 mass parts of the high molecular weight polymer (H-1) and mixed thoroughly under reflux followed by distillative removal of the organic solvent to yield a binder resin 1, which was a styrene-acrylic resin (described as styrene-acrylic resin in Table 2). The binder resin had the glass-transition temperature (Tg) of 54° C., the weight-average molecular weight (Mw) of 200,000 and the number-average molecular weight (Mn) of 10,000.

<Production Example of Binder Resin 2>

To a reaction vessel were charged 50 mass parts of a bisphenol A-propylene oxide (PO) (2 moles) adduct represented by the following formula (A) (wherein R represents a propylene group and an average of x+y is 2), 20 mass parts of a bisphenol A-ethylene oxide (EO) (2 moles) adduct represented by the following formula (A) (wherein R represents an ethylene group and an average of x+y is 2), 20 mass parts of terephthalic acid, 5 mass parts of fumaric acid, 5 mass parts of trimellitic anhydride and 0.5 mass parts of dibutyltin oxide and were condensation polymerized at 220° C. to obtain a binder resin 2 which was a polyester (described as polyester resin in Table 2). This resin had the weight-average molecular weight (Mw) of 680,000, the acid value of 24 mg-KOH/g and the glass transition temperature (Tg) of 59° C.

[C 2]

(A)

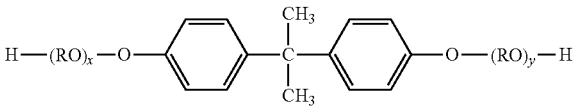

<Production of Magnetic Powder 1>

A ferrous sulfate aqueous solution was mixed with 1.0 iron-ion equivalent of caustic soda solution to prepare an aqueous solution containing ferrous hydroxide. The aqueous solution was maintained at pH 9 while bubbling air to carry out oxidation reaction at 80° C., thereby preparing a slurry for production of seed crystals.

The slurry was added with a ferrous sulfate aqueous solution so as to be 0.9 to 1.2 equivalents relative to the initial amount of alkaline (sodium component of caustic soda) and maintained at pH 7.6 and oxidation reaction was carried out while bubbling air therein to obtain a slurry containing magnetic iron oxide. This aqueous slurry was recovered after filtration and washing. The aqueous slurry was filtered, thoroughly washed and dried before crashing the obtained particles to obtain magnetic powder 1. The obtained magnetic powder 1 had the volume-average particle diameter of 0.23 μm and the saturation magnetization and the residual magnetization at a magnetic field 79.6 kA/m (1000 Oersted) of 67.3 $Am^2/kg$ (emu/g) and 4.5 $Am^2/kg$ (emu/g), respectively.

[Production Examples of Magnetic Toner]

<Production Example of Magnetic Toner 1>

| | |
|---|---|
| Binder resin 1 | 100 mass parts |
| Magnetic powder 1 | 90 mass parts |
| Monoazo iron complex (T-77: Hodogaya Chemical Co., Ltd.) | 2 mass parts |
| Low molecular weight polyethylene wax( melting point 92° C.) | 4 mass parts |

The above starting materials were pre-mixed in a Henschel mixer and melt-kneaded with a twin-screw extruder heated at 110° C. The kneaded material was cooled, coarsely pulverized with a hammer mill to obtain a coarsely pulverized magnetic toner. The coarsely pulverized material was finely pulverized using a mechanical pulverizer Turbo Mill (Turbo Kogyo Co., Ltd.; the surface of a rotor and stator was coated with chromium alloy plating containing chromium carbide (plating thickness: 150 μm, surface hardness: HV1050)) for mechanical pulverization. The obtained finely pulverized material was subjected to classification performed using a Coanda effect-based multifraction classifier (Elbow Jet classifier from Nittetsu Mining, Co., Ltd.) to classify and recover fine powder and coarse powder simultaneously.

The magnetic toner particles (100 mass parts) were mixed with 1.5 mass parts of hydrophobic silica fine powder which was obtained by treating silica fine powder having number-average primary particle diameter of 12 nm with hexamethyldisilazane followed by treatment with silicone oil, so that it had the BET value after the treatment of 120 $m^2/g$ in a Henschel mixer (Mitsui Miike Kakoki K.K.) in order to carry out external addition prior to hot air treatment.

The magnetic toner particles after the external addition prior to hot air treatment were subjected to surface modification using a Meteorainbow (Nippon Pneumatic Mfg. Co., Ltd.), which is a device that carries out the surface modification of magnetic toner particles using a hot air blast. The surface modification conditions were a starting material feed rate of 2 kg/hr, a hot air flow rate of 700 L/min, and a hot air ejection temperature of 300° C.

The magnetic toner particles after hot air treatment (100 mass parts) were mixed with 1.0 mass part of hydrophobic silica fine powder which was obtained by treating silica having number-average primary particle diameter of 12 nm with hexamethyldisilazane followed by treatment with silicone oil, so that it had the BET value after the treatment of 120 $m^2/g$ in a Henschel mixer (Mitsui Miike Kakoki K.K.) in order to carry out external addition after hot air treatment to obtain magnetic toner 1 having the weight-average particle diameter (D4) of 6.5 μm. Physical properties of the magnetic toner 1 are shown in Table 2.

<Production Examples of Magnetic Toners 2 to 8, 10 to 11, 13 and 15 to 16>

The magnetic toners 2 to 8, 10 to 11, 13 and 15 to 16 were obtained by varying the conditions for hot air, external addition prior to hot air treatment and external addition after hot air treatment. Physical properties of the magnetic toners are shown in Table 2.

<Production Examples of Magnetic Toners 9, 12, 14 and 17>

The magnetic toners 9, 12, 14 and 17 were prepared by using the binder resin 2 instead of the binder resin 1 used for the magnetic toner 1 and varying the conditions for hot air, external addition prior to hot air treatment and external addition after hot air treatment. Physical properties of the magnetic toners are shown in Table 2.

TABLE 2

| Magnetic toner Production Example | Binder resin | Hot air flow rate (L/min) | Hot air ejection temperature (° C.) | Externally added silica prior to hot air treatment (parts) | Externally added silica after hot air treatment (parts) | Weight-average particle diameter (D4) (μm) | Average circularity | Surface tension index ($\times 10^{-3}$ N/m) | Reduction rate of silicon element (mass %) | 2 to 10 μm aspect ratio | Aspect ratio standard deviation |
|---|---|---|---|---|---|---|---|---|---|---|---|
| 1 | Styrene-acrylic resin | 700 | 300 | 1.5 | 1 | 6.5 | 0.965 | 10 | 35 | 0.85 | 0.05 |
| 2 | Styrene-acrylic resin | 750 | 300 | 1.5 | 1 | 6.5 | 0.963 | 9 | 40 | 0.9 | 0.11 |
| 3 | Styrene-acrylic resin | 700 | 320 | 1.5 | 1 | 6.4 | 0.968 | 15 | 30 | 0.7 | 0.08 |
| 4 | Styrene-acrylic resin | 650 | 320 | 1.5 | 1 | 6.5 | 0.968 | 20 | 25 | 0.65 | 0.13 |
| 5 | Styrene-acrylic resin | 700 | 300 | 1.5 | 0.8 | 6.6 | 0.966 | 8 | 10 | 0.87 | 0.03 |
| 6 | Styrene-acrylic resin | 700 | 300 | 2.2 | 0.9 | 6.5 | 0.964 | 15 | 50 | 0.84 | 0.06 |
| 7 | Styrene-acrylic resin | 700 | 300 | 1 | 0.6 | 6.4 | 0.967 | 7 | 8 | 0.88 | 0.05 |
| 8 | Styrene-acrylic resin | 700 | 300 | 2.4 | 1 | 6.5 | 0.96 | 30 | 55 | 0.65 | 0.12 |
| 9 | Polyester resin | 700 | 300 | — | 1 | 6.5 | 0.965 | 7 | 32 | 0.85 | 0.05 |
| 10 | Styrene-acrylic resin | 700 | 300 | 1.5 | 1 | 6.6 | 0.965 | 10 | 35 | 0.85 | 0.05 |
| 11 | Styrene-acrylic resin | 700 | 300 | 1.5 | 1 | 6.5 | 0.96 | 100 | 51 | 0.6 | 0.15 |
| 12 | Polyester resin | 700 | 300 | — | 1 | 6.4 | 0.955 | 5 | 55 | 0.63 | 0.15 |
| 13 | Styrene-acrylic resin | 700 | 300 | — | 1 | 6.5 | 0.95 | 6 | 52 | 0.68 | 0.11 |
| 14 | Polyester resin | 750 | 280 | — | 1 | 6.5 | 0.952 | 4 | 55 | 0.65 | 0.12 |
| 15 | Styrene-acrylic resin | 650 | 320 | — | 1 | 6.4 | 0.954 | 120 | 51 | 0.58 | 0.18 |
| 16 | Styrene-acrylic resin | — | — | No hot air treatment | 1 | 6.6 | 0.93 | 6 | 63 | 0.68 | 0.12 |
| 17 | Polyester resin | — | — | No hot air treatment | 1 | 6.5 | 0.93 | 5.1 | 60 | 0.68 | 0.12 |

Example 1

In a process cartridge for a commercially available laser beam printer (Laser Jet P3015 (HP)), the magnetic toner-carrying member 1 containing a magnet having a developing pole of 750 gauss therein was incorporated and a toner regulating member containing a support member of a phosphor bronze plate having a thickness of 100 μm onto which a blade material of a polyphenylene sulfide film (Torelina film type 3000, Toray Industries, Inc.) having a thickness of 100 μm was bonded was used. The surface of the polyphenylene sulfide was subjected to taper grinding and the surface roughness (RaB) at the portion contacting the magnetic toner-carrying member was 0.48 μm.

The toner regulating member 12 is fixed in a developer container such that, as shown in FIG. 4, one free end of the toner regulating member 12 is sandwiched with two metal elastic bodies 13 and fixed with screws in order to prevent corrugating in the longitudinal direction. The other free end of the toner regulating member 12 contacts at the end thereof the surface of the magnetic toner-carrying member 3 at predetermined pressure, so that the shape thereof is changed by elasticity. The toner regulating member 12 regulates the thickness of a layer of magnetic toner 14 attracted to the surface of the magnetic toner-carrying member Table by means of magnetism of the magnet 16. In the present Example, pressure applied to the magnetic toner-carrying member 3 by the toner regulating member 12 was 10 N/m and the distance between the position where the toner regulating member contacts the magnetic toner-carrying member and the free end was 2 mm. Summary of configurations is shown in Table 3.

The process cartridge modified as above was mounted on the above LBP printer (Laser Jet P3015, HP). The evaluations were carried out under the following environments: normal temperature and normal humidity (25° C., 50% RH), low temperature and low humidity (15° C., 10% RH) and high temperature and high humidity (32.5° C., 80% RH).

The following evaluations were performed at the initial stage of the printing durability test or after a durability test for 4000 prints. Evaluation results are shown in Tables 4 to 6.

<Image Density>

At the initial stage or after completing 4000 prints, a solid image area was formed and used for evaluation. The image density was measured with an image density measurement apparatus, "MacBeth reflection densitometer" (MacBeth Corporation) as relative density to a white zone in a printout image having the density of 0.00.

A: 1.50 or more

B: 1.40 or more and less than 1.50

C: 1.30 or more and less than 1.40

D: Less than 1.30

<Dot Reproducibility>

Figure 5:
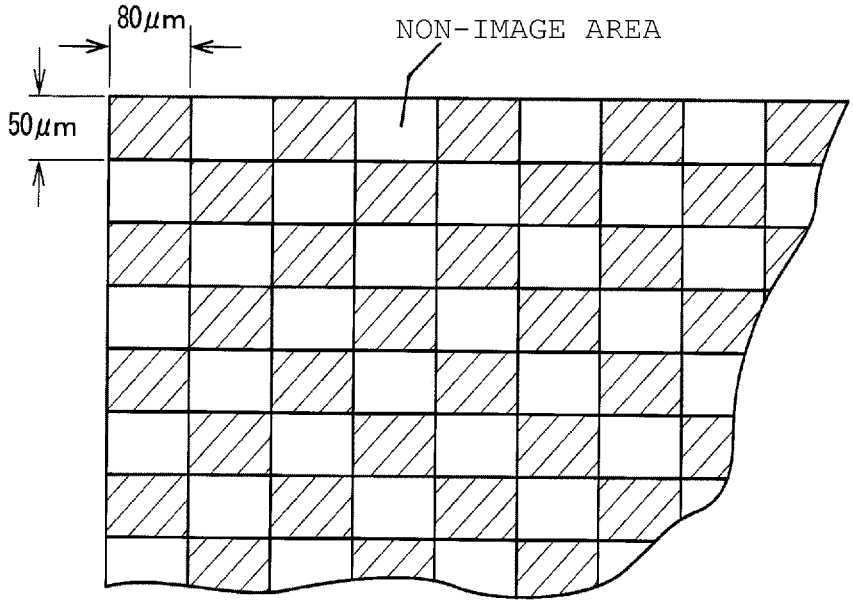
FIG. 5 is a checker pattern used for evaluation of dot reproducibility.

The dot reproducibility was evaluated by printing the checker pattern of 80 μm×50 μm shown in FIG. 5 for an image printing test and observing the presence or absence of defects in black zones with a microscope.

A: Two or less defects among 100

B: Three or more and 5 or less defects among 100

C: Six or more and 10 or less defects among 100

D: Eleven or more defects among 100

<Transfer Efficiency>

The transfer efficiency was calculated approximately from the following equation, wherein C is the MacBeth density of a Mylar tape on a sheet of paper which was obtained by peeling off the remaining toner on the photosensitive member after transferring a solid black image, D is the MacBeth density of a Mylar tape on a sheet of paper onto which magnetic toner after transfer and before fixing was mounted and E is MacBeth density of a Mylar tape on a sheet of paper which was not used.

$$\text{Transfer efficiency}(\%)=\{(D-C)/(D-E)\}\times 100$$

The transfer efficiency of 90% or more may provide a fair image.

A: 97% or more

B: 94% to less than 97%

C: 90% to less than 94%

D: Less than 90%

<Image Density Non-Uniformity>

In the image printing test, a halftone image was printed out and evaluated for the image uniformity (image density non-uniformity) thereof. The density was measured with a MacBeth reflection densitometer (MacBeth Corporation).

A: Difference in reflection density between the maximum and minimum densities is less than 0.03

B: Difference in reflection density between the maximum and minimum densities is 0.03 or more and less than 0.06

C: Difference in reflection density between the maximum and minimum densities is 0.06 or more and less than 0.10

D: Difference in reflection density between the maximum and minimum densities is 0.10 or more

Examples 2 to 21 and Comparative Examples 1 to 9

Evaluations were performed in the same manner as Example 1 with the configurations shown in Table 3. Evaluation results are shown in Tables 4 to 6.

TABLE 3

| | Magnetic toner | Toner regulating member | Magnetic toner-carrying member | RaS of magnetic toner-carrying member (μm) | Work function value of magnetic toner-carrying member surface (eV) | RaS/RaB |
|---|---|---|---|---|---|---|
| Example | | | | | | |
| 1 | 1 | PPS | 1 | 0.95 | 4.8 | 2.0 |
| 2 | 2 | PPS | 1 | 0.95 | 4.8 | 2.0 |
| 3 | 3 | PPS | 1 | 0.95 | 4.8 | 2.0 |
| 4 | 4 | PPS | 1 | 0.95 | 4.8 | 2.0 |
| 5 | 5 | PPS | 1 | 0.95 | 4.8 | 2.0 |
| 6 | 6 | PPS | 1 | 0.95 | 4.8 | 2.0 |
| 7 | 7 | PPS | 1 | 0.95 | 4.8 | 2.0 |
| 8 | 8 | PPS | 1 | 0.95 | 4.8 | 2.0 |
| 9 | 8 | PPS | 4 | 0.60 | 4.8 | 1.0 |
| 10 | 8 | PPS | 5 | 1.50 | 4.8 | 3.0 |
| 11 | 8 | PPS | 6 | 0.50 | 4.8 | 0.8 |
| 12 | 8 | PPS | 7 | 1.70 | 4.8 | 3.2 |
| 13 | 9 | PPS | 1 | 0.95 | 4.8 | 2.0 |
| 14 | 10 | Olefin | 1 | 0.95 | 4.8 | 2.0 |
| 15 | 11 | PPS | 1 | 0.95 | 4.8 | 2.0 |
| 16 | 12 | PPS | 1 | 0.95 | 4.8 | 2.0 |
| 17 | 13 | PPS | 1 | 0.95 | 4.8 | 2.0 |
| 18 | 8 | PPS | 2 | 0.95 | 4.6 | 2.0 |
| 19 | 8 | PPS | 3 | 0.95 | 4.9 | 2.0 |
| 20 | 8 | Olefin | 2 | 0.95 | 4.6 | 2.0 |
| 21 | 8 | Olefin | 3 | 0.95 | 4.9 | 2.0 |
| Comparative Example | | | | | | |
| 1 | 14 | PPS | 1 | 0.95 | 4.8 | 2.0 |
| 2 | 15 | PPS | 1 | 0.95 | 4.8 | 2.0 |
| 3 | 16 | PPS | 1 | 0.95 | 4.8 | 2.0 |
| 4 | 17 | PPS | 1 | 0.95 | 4.8 | 2.0 |
| 5 | 13 | Polycarbonate | 1 | 0.95 | 4.8 | 2.0 |
| 6 | 13 | Silicone | 1 | 0.95 | 4.8 | 2.0 |
| 7 | 13 | PET | 1 | 0.95 | 4.8 | 2.0 |
| 8 | 8 | PPS | 8 | 0.95 | 4.5 | 2.0 |
| 9 | 8 | PPS | 9 | 0.95 | 5.0 | 2.0 |

In the above Table, PPS represents the above polyphenylene sulfide film, polycarbonate sheet (PC) represents a Panlite sheet (PC-2151: Teijin Chemicals Ltd.), PET represents a polyethylene terephthalate film (Teijin Tetoron film G2: Teijin DuPont Films Japan Limited) and silicone represents a silicon rubber sheet (SC50NNS: Kureha Elastomer Co., Ltd.). As olefin, a polypropylene film (Novatec PP FW4BT: Japan Polypropylene Corporation) was used. The regulating members used were, as Example 1, the ones obtained by bonding PC, PET, olefin or silicone on the surface of a phosphor bronze plate having a thickness of 100 μm and subjected to taper grinding.

TABLE 4

| | Under normal temperature and normal humidity environment (25.0° C., 50% RH) | | | | | | | |
|---|---|---|---|---|---|---|---|---|
| | Image density | | Dot reproducibility (number of image defects) | | Transfer efficiency (%) | | Image density non-uniformity | |
| | Initial | After 4000 prints | Initial | After 4000 prints | Initial | After 4000 prints | Initial | After 4000 prints |
| Example | | | | | | | | |
| 1 | A (1.55) | A (1.54) | A (0) | A (0) | A (99) | A (99) | A (0.01) | A (0.01) |
| 2 | A (1.54) | A (1.53) | A (0) | A (1) | A (99) | A (97) | A (0.01) | A (0.01) |
| 3 | A (1.52) | A (1.50) | A (0) | A (1) | A (99) | A (97) | A (0.01) | A (0.01) |
| 4 | A (1.54) | A (1.53) | A (1) | A (1) | A (98) | A (98) | B (0.03) | A (0.01) |
| 5 | A (1.53) | A (1.50) | A (1) | A (2) | A (98) | A (97) | B (0.03) | A (0.02) |
| 6 | A (1.53) | A (1.51) | A (1) | A (2) | A (98) | A (97) | A (0.01) | B (0.03) |
| 7 | A (1.53) | A (1.50) | A (1) | A (2) | B (95) | A (97) | B (0.03) | A (0.01) |
| 8 | A (1.52) | B (1.49) | A (2) | B (3) | A (97) | B (95) | A (0.01) | B (0.04) |
| 9 | A (1.52) | B (1.48) | A (2) | B (4) | B (94) | B (95) | A (0.02) | B (0.03) |
| 10 | A (1.53) | B (1.47) | B (3) | B (5) | A (98) | B (95) | B (0.03) | B (0.05) |
| 11 | A (1.52) | B (1.45) | B (4) | B (5) | B (96) | B (95) | B (0.04) | B (0.05) |
| 12 | A (1.54) | B (1.46) | C (8) | B (5) | B (96) | B (96) | B (0.04) | B (0.05) |
| 13 | A (1.55) | A (1.53) | A (0) | A (1) | A (98) | A (99) | A (0.01) | A (0.02) |
| 14 | A (1.54) | A (1.51) | A (0) | A (2) | A (98) | A (99) | A (0.01) | A (0.02) |
| 15 | A (1.53) | B (1.45) | B (3) | B (4) | B (96) | B (95) | B (0.04) | C (0.08) |
| 16 | A (1.52) | B (1.46) | B (4) | B (5) | B (95) | C (92) | B (0.03) | B (0.05) |
| 17 | B (1.49) | C (1.38) | B (5) | C (9) | C (92) | C (93) | C (0.06) | C (0.08) |
| 18 | B (1.48) | B (1.42) | B (3) | B (5) | B (95) | B (96) | C (0.07) | B (0.05) |
| 19 | B (1.47) | B (1.43) | C (6) | B (4) | B (94) | B (96) | C (0.07) | B (0.05) |
| 20 | B (1.48) | B (1.44) | B (4) | B (5) | B (96) | B (95) | C (0.06) | B (0.04) |
| 21 | B (1.47) | B (1.43) | C (8) | B (5) | B (96) | B (94) | C (0.06) | B (0.04) |
| Comparative Example | | | | | | | | |
| 1 | B (1.45) | C (1.36) | C (8) | C (10) | B (95) | C (92) | C (0.06) | C (0.09) |
| 2 | B (1.44) | C (1.35) | C (6) | C (9) | B (94) | C (90) | C (0.06) | D (0.18) |
| 3 | B (1.43) | C (1.34) | C (10) | D (15) | C (93) | C (90) | C (0.07) | D (0.19) |
| 4 | C (1.38) | C (1.32) | C (8) | D (14) | C (92) | C (90) | C (0.08) | D (0.20) |
| 5 | B (1.45) | C (1.37) | B (4) | C (9) | C (93) | C (92) | C (0.07) | C (0.09) |
| 6 | B (1.44) | C (1.36) | C (6) | C (10) | C (91) | D (87) | C (0.06) | D (0.17) |
| 7 | B (1.43) | C (1.35) | C (7) | C (10) | C (90) | D (86) | C (0.07) | D (0.15) |
| 8 | B (1.42) | C (1.36) | C (6) | C (10) | C (92) | C (91) | C (0.07) | D (0.16) |
| 9 | B (1.42) | C (1.37) | D (15) | C (10) | C (90) | D (83) | D (0.14) | D (0.18) |

TABLE 5

| | Under low temperature and low humidity environment (15.0° C., 10% RH) | | | | | | | |
|---|---|---|---|---|---|---|---|---|
| | Image density | | Dot reproducibility (number of image defects) | | Transfer efficiency (c/o) | | Image density non-uniformity | |
| | Initial | After 4000 prints | Initial | After 4000 prints | Initial | After 4000 prints | Initial | After 4000 prints |
| Example | | | | | | | | |
| 1 | A (1.56) | A (1.55) | A (0) | A (0) | A (99) | A (99) | A (0.01) | A (0.01) |
| 2 | A (1.54) | A (1.53) | A (0) | A (0) | A (99) | A (97) | B (0.03) | A (0.01) |
| 3 | A (1.55) | A (1.53) | A (1) | A (1) | A (99) | A (97) | A (0.01) | A (0.01) |
| 4 | A (1.54) | A (1.51) | A (1) | A (1) | A (98) | A (98) | B (0.03) | A (0.02) |
| 5 | A (1.53) | A (1.50) | A (1) | A (1) | A (97) | A (98) | B (0.03) | A (0.01) |
| 6 | A (1.54) | A (1.52) | A (1) | A (2) | A (97) | B (96) | A (0.01) | B (0.04) |
| 7 | A (1.53) | A (1.51) | A (1) | A (2) | B (96) | A (97) | B (0.04) | A (0.02) |
| 8 | A (1.54) | A (1.51) | A (1) | B (3) | A (97) | B (95) | A (0.01) | B (0.03) |
| 9 | A (1.55) | A (1.53) | A (2) | B (4) | B (94) | B (96) | B (0.03) | B (0.04) |
| 10 | A (1.54) | A (1.52) | B (3) | B (4) | A (97) | B (95) | B (0.04) | B (0.05) |
| 11 | A (1.55) | B (1.49) | B (4) | B (5) | B (94) | B (96) | C (0.06) | B (0.05) |
| 12 | A (1.55) | A (1.50) | C (6) | B (5) | B (94) | B (96) | C (0.07) | B (0.05) |
| 13 | A (1.54) | A (1.51) | B (3) | A (1) | B (94) | A (97) | A (0.02) | A (0.01) |

TABLE 5-continued

| | Under low temperature and low humidity environment (15.0° C., 10% RH) | | | | | | | |
|---|---|---|---|---|---|---|---|---|
| | Image density | | Dot reproducibility (number of image defects) | | Transfer efficiency (c/o) | | Image density non-uniformity | |
| | Initial | After 4000 prints | Initial | After 4000 prints | Initial | After 4000 prints | Initial | After 4000 prints |
| 14 | A (1.54) | A (1.52) | A (1) | A (1) | A (97) | A (98) | B (0.04) | A (0.01) |
| 15 | A (1.52) | B (1.47) | B (3) | C (6) | B (94) | B (95) | C (0.06) | C (0.09) |
| 16 | B (1.49) | B (1.45) | B (4) | B (5) | B (94) | C (92) | C (0.06) | B (0.05) |
| 17 | B (1.44) | C (1.37) | B (3) | C (6) | C (93) | C (91) | C (0.07) | C (0.08) |
| 18 | B (1.47) | B (1.42) | C (6) | C (9) | C (91) | B (95) | C (0.07) | C (0.08) |
| 19 | B (1.48) | B (1.43) | C (6) | B (5) | C (92) | C (93) | C (0.06) | C (0.07) |
| 20 | B (1.46) | B (1.41) | C (6) | C (9) | C (93) | B (94) | C (0.08) | C (0.09) |
| 21 | B (1.45) | B (1.41) | C (7) | B (4) | C (90) | C (93) | C (0.08) | C (0.09) |
| Comparative Example | | | | | | | | |
| 1 | B (1.44) | C (1.37) | B (4) | C (8) | B (94) | C (92) | C (0.09) | D (0.18) |
| 2 | B (1.42) | C (1.36) | C (9) | D (15) | C (92) | C (90) | D (0.13) | D (0.17) |
| 3 | C (1.35) | D (1.28) | C (7) | D (13) | C (90) | D (86) | D (0.15) | D (0.22) |
| 4 | C (1.33) | D (1.25) | C (6) | C (9) | C (93) | D (85) | D (0.14) | D (0.21) |
| 5 | B (1.40) | D (1.27) | C (8) | D (14) | C (91) | D (86) | D (0.17) | D (0.16) |
| 6 | C (1.33) | D (1.26) | C (6) | D (14) | C (92) | D (84) | D (0.16) | D (0.17) |
| 7 | C (1.34) | D (1.25) | C (10) | D (16) | C (91) | D (83) | D (0.14) | D (0.16) |
| 8 | C (1.36) | C (1.31) | C (8) | D (16) | C (91) | C (90) | D (0.15) | D (0.16) |
| 9 | C (1.35) | C (1.30) | D (16) | D (18) | C (90) | D (83) | D (0.14) | D (0.17) |

TABLE 6

| | Under high temperature and high humidity environment (32.5° C., 80% RH) | | | | | | | |
|---|---|---|---|---|---|---|---|---|
| | Image density | | Dot reproducibility (number of image defects) | | Transfer efficiency (%) | | Image density non-uniformity | |
| | Initial | After 4000 prints | Initial | After 4000 prints | Initial | After 4000 prints | Initial | After 4000 prints |
| Example | | | | | | | | |
| 1 | A (1.56) | A (1.54) | A (0) | A (0) | A (99) | A (99) | A (0.01) | A (0.01) |
| 2 | A (1.55) | A (1.53) | A (0) | A (1) | A (99) | A (98) | B (0.03) | A (0.01) |
| 3 | A (1.54) | A (1.52) | A (1) | A (1) | A (99) | A (98) | A (0.01) | A (0.01) |
| 4 | A (1.54) | A (1.52) | A (1) | A (1) | A (98) | A (98) | B (0.03) | A (0.02) |
| 5 | A (1.55) | A (1.52) | A (1) | A (1) | A (98) | A (97) | B (0.03) | A (0.02) |
| 6 | A (1.54) | A (1.51) | A (1) | A (2) | A (97) | B (95) | A (0.01) | B (0.04) |
| 7 | A (1.53) | A (1.50) | A (1) | A (2) | B (95) | A (97) | B (0.04) | A (0.02) |
| 8 | A (1.54) | B (1.49) | A (1) | B (3) | A (97) | B (94) | A (0.01) | B (0.03) |
| 9 | A (1.54) | B (1.47) | A (2) | B (4) | B (95) | B (95) | B (0.04) | B (0.05) |
| 10 | A (1.53) | B (1.48) | B (3) | B (5) | A (97) | B (94) | B (0.04) | B (0.05) |
| 11 | A (1.52) | B (1.47) | B (4) | C (6) | B (96) | B (94) | C (0.06) | B (0.05) |
| 12 | A (1.51) | B (1.46) | C (6) | B (5) | B (95) | B (94) | C (0.07) | B (0.05) |
| 13 | A (1.54) | A (1.51) | B (3) | A (1) | A (98) | A (97) | B (0.04) | B (0.05) |
| 14 | A (1.54) | A (1.51) | B (3) | A (1) | A (97) | A (97) | B (0.05) | A (0.02) |
| 15 | A (1.50) | C (1.39) | B (4) | C (9) | B (94) | B (94) | C (0.07) | C (0.09) |
| 16 | B (1.48) | B (1.43) | B (3) | C (10) | B (95) | C (93) | C (0.08) | B (0.05) |
| 17 | B (1.44) | C (1.38) | B (5) | C (8) | C (92) | C (93) | C (0.07) | C (0.09) |
| 18 | B (1.46) | B (1.41) | B (4) | C (9) | C (93) | B (94) | C (0.09) | B (0.05) |
| 19 | B (1.46) | B (1.43) | C (6) | C (10) | C (91) | C (91) | C (0.09) | C (0.09) |
| 20 | B (1.47) | B (1.42) | B (5) | C (10) | C (92) | B (95) | C (0.08) | B (0.05) |
| 21 | B (1.46) | B (1.42) | C (8) | C (10) | C (93) | C (90) | C (0.08) | C (0.09) |
| Comparative Example | | | | | | | | |
| 1 | B (1.44) | C (1.36) | B (5) | C (10) | B (94) | D (86) | C (0.09) | D (0.19) |
| 2 | B (1.44) | C (1.36) | C (7) | D (12) | C (92) | C (90) | D (0.15) | D (0.20) |
| 3 | C (1.35) | D (1.28) | C (8) | D (14) | C (91) | D (84) | D (0.16) | D (0.22) |
| 4 | B (1.45) | C (1.36) | C (8) | C (10) | C (91) | D (86) | D (0.17) | D (0.24) |
| 5 | B (1.44) | C (1.36) | C (7) | D (17) | C (90) | D (85) | D (0.16) | D (0.18) |
| 6 | B (1.43) | C (1.34) | C (8) | D (17) | C (92) | D (84) | D (0.14) | D (0.17) |
| 7 | B (1.44) | C (1.35) | C (9) | D (16) | C (93) | D (83) | C (0.09) | D (0.16) |
| 8 | B (1.43) | C (1.32) | C (9) | D (18) | C (91) | D (82) | D (0.14) | D (0.18) |
| 9 | B (1.42) | C (1.31) | C (10) | D (18) | C (90) | D (81) | D (0.16) | D (0.17) |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-285914, filed Dec. 27, 2011, which is hereby incorporated by reference herein in its entirety.

What is claimed is:

1. A developing apparatus comprising an electrostatic latent image bearing member on which an electrostatic latent image is formed, magnetic toner for developing the electrostatic latent image formed on the electrostatic latent image bearing member, a magnetic toner-carrying member arranged so as to oppose the electrostatic latent image bearing member for carrying and transporting the magnetic toner, and a toner regulating member contacting the magnetic toner-carrying member and regulating the magnetic toner carried on the magnetic toner-carrying member, wherein:

the magnetic toner-carrying member has a work function value of 4.6 eV or more and 4.9 eV or less, a portion of the toner regulating member, which is contacting the magnetic toner, is made of a polyphenylene sulfide or a polyolefin, and the magnetic toner i) comprises magnetic toner particles, each of which contains a binder resin and magnetic powder, and inorganic fine powder, ii) has negative charging property, iii) has an average circularity of 0.950 or more, and iv) has a surface tension index I for a 45 volume % aqueous solution of methanol measured by the capillary suction time method and calculated by the following equation (1) of $5.0\times10^{-3}$ N/m or more and $1.0\times10^{-1}$ N/m or less:

$$I=P\alpha/(A\times B\times10^{6}) \quad (1)$$

wherein in the equation (1), I represents the surface tension index (N/m) of the magnetic toner; Pα represents a capillary pressure ($N/m^2$) of the magnetic toner for the 45 volume % aqueous solution of methanol; A represents a specific surface area ($m^2/g$) of the magnetic toner; and B represents a true density ($g/cm^3$) of the magnetic toner.

2. The developing apparatus according to claim 1, wherein the magnetic toner-carrying member has a surface roughness (RaS) of 0.60 μm or more and 1.50 μm or less, and a ratio [RaS/RaB] of the surface roughness (RaS) of the magnetic toner-carrying member to a surface roughness (RaB) of the portion, of the toner regulating member, which contacts the magnetic toner is 1.0 or more and 3.0 or less.

3. The developing apparatus according to claim 1, wherein the inorganic fine powder contains silica fine powder, and when soaked in an alkaline aqueous solution, the magnetic toner has a reduction rate of a silicon element of 10 mass % or more and 50 mass % or less.

4. The developing apparatus according to claim 1, wherein the magnetic toner particles or the magnetic toner is obtained by surface treatment with hot air.

5. A method for developing an electrostatic latent image formed on an electrostatic latent image bearing member using magnetic toner that is carried on a magnetic toner-carrying member arranged so as to oppose the electrostatic latent image bearing member and that is regulated by a toner regulating member contacting the magnetic toner-carrying member, wherein:

the magnetic toner-carrying member has a work function value at the surface of 4.6 eV or more and 4.9 eV or less, a portion of the toner regulating member, which is contacting the magnetic toner, is made of a polyphenylene sulfide or a polyolefin, and the magnetic toner i) comprises magnetic toner particles, each of which contains a binder resin and magnetic powder, and inorganic fine powder, ii) has negative charging property, iii) has an average circularity of 0.950 or more, and iv) has a surface tension index I for a 45 volume % aqueous solution of methanol measured by the capillary suction time method and calculated by the following equation (1) of $5.0\times10^{-3}$ N/m or more and $1.0\times10^{-1}$ N/m or less:

$$I=P\alpha/(A\times B\times10^{6}) \quad (1)$$

wherein in the equation (1), I represents the surface tension index (N/m) of the magnetic toner; Pα represents a capillary pressure ($N/m^2$) of the magnetic toner for the 45 volume % aqueous solution of methanol; A represents a specific surface area ($m^2/g$) of the magnetic toner; and B represents a true density ($g/cm^3$) of the magnetic toner.

* * * * *